US005424809A

United States Patent [19]

Sawayama et al.

[11] Patent Number: 5,424,809

[45] Date of Patent: Jun. 13, 1995

[54] IMAGE FORMING METHOD AND APPARATUS FOR THE SAME

[75] Inventors: Noboru Sawayama, Tokyo; Yoshihiro Mitekura, Yokohama; Takayuki Maruta, Tokyo; Katsuhiro Aoki, Yokohama; Koji Okabayashi, Yokohama, all of Japan

[73] Assignee: Ricoh Comapany, Ltd., Tokyo, Japan

[21] Appl. No.: 31,015

[22] Filed: Mar. 11, 1993

Related U.S. Application Data

[63] Continuation of Ser. No. 691,727, Apr. 26, 1991, abandoned.

[30] Foreign Application Priority Data

| | | | |
|---|---|---|---|
| Apr. 27, 1990 | [JP] | Japan | 2-113092 |
| Apr. 27, 1990 | [JP] | Japan | 2-113093 |
| Aug. 10, 1990 | [JP] | Japan | 2-213339 |
| Aug. 20, 1990 | [JP] | Japan | 2-219805 |
| Aug. 20, 1990 | [JP] | Japan | 2-219806 |
| Aug. 20, 1990 | [JP] | Japan | 2-219809 |
| Aug. 20, 1990 | [JP] | Japan | 2-219810 |
| Aug. 20, 1990 | [JP] | Japan | 2-219811 |
| Oct. 5, 1990 | [JP] | Japan | 2-268016 |
| Nov. 13, 1990 | [JP] | Japan | 2-306525 |
| Feb. 5, 1991 | [JP] | Japan | 3-035371 |

[51] Int. Cl.[6] ..... G03G 21/00

[52] U.S. Cl. ..... 355/208; 355/214; 355/246

[58] Field of Search ..... 355/203, 204, 206, 208, 355/210, 214, 246; 118/689, 690; 358/80, 504,518

[56] References Cited

U.S. PATENT DOCUMENTS

| | | | |
|---|---|---|---|
| 4,049,939 | 9/1991 | Koichi | 355/246 |
| 4,178,095 | 12/1979 | Champion et al. | 355/203 |
| 4,248,527 | 2/1981 | Akiyama et al. | 355/246 |
| 4,277,162 | 7/1981 | Kasahara et al. | 355/208 |
| 4,313,671 | 2/1982 | Kuru | 355/246 X |
| 4,348,099 | 9/1982 | Fantozzi | 355/246 |
| 4,466,731 | 8/1984 | Champion et al. | 355/246 |
| 4,519,695 | 5/1985 | Murai et al. | 355/246 |
| 4,572,654 | 3/1986 | Murai et al. | 355/246 X |
| 4,647,184 | 3/1987 | Russell et al. | 355/208 |
| 4,780,744 | 10/1988 | Porter et al. | 355/208 |
| 4,786,924 | 11/1987 | Folkins | 355/208 |
| 4,866,481 | 9/1989 | Yamada | 355/208 |
| 4,870,460 | 9/1989 | Harada et al. . | |
| 4,888,636 | 12/1989 | Abe | 355/326 X |
| 4,894,685 | 1/1990 | Shoji | 355/246 |
| 4,910,557 | 3/1990 | Imai | 355/246 |
| 4,949,135 | 8/1990 | Ng | 355/246 X |
| 4,962,407 | 10/1990 | Ueda | 355/208 |

FOREIGN PATENT DOCUMENTS

| | | |
|---|---|---|
| 0338963 | 10/1989 | European Pat. Off. . |
| 2212419 | 7/1989 | United Kingdom . |

*Primary Examiner*—Benjamin R. Fuller
*Assistant Examiner*—John E. Barlow, Jr.
*Attorney, Agent, or Firm*—Oblon, Spivak, McClelland, Maier & Neustadt

[57] ABSTRACT

An image forming method and an apparatus therefor applicable to a color copier. A signal value representative of a reflection and appearing when the output of a photosensor is minimum in response to a change in the amount of toner deposition on a photoconductive element is detected. This maintains the density of a predetermined reference pattern used to sense an image density constant despite the change in, for example, the reflection characteristic of the photoconductive element. A bias for development is so changed as to maintain the output of the photosensor constant, so that the effective bias remains constant relative to the charge potential on the photoconductive element.

11 Claims, 40 Drawing Sheets

MORNING CYCLE
CHECK $V_{sg}^{+}$
SENSE PATTEN BY PHOTOSENSOR
INPUT V(1)~V(7)
CALCULATE $V_{k1}$, NGRD123 & NGRD4567 & COMPARE TEM WITH PREDETERMINED VALUE TO SEPARATE INTO 27 GROUPS
DECIDE BY DECISION TABLE
PASS ?
NO
YES

Fig. 6A

| DATA | | |
|---|---|---|
| GRD (123) | GRD (4567) | $V_k$ CORRECTION |
| (SMALL) | (Up) | a EXCESS |
| (SMALL) | (Up) | b ADEQUATE |
| (SMALL) | (Up) | c SHORT |
| (SMALL) | (Flat) | a EXCESS |
| (SMALL) | (Flat) | b ADEQUATE |
| (SMALL) | (Flat) | c SHORT |
| (SMALL) | (Down) | a EXCESS |
| (SMALL) | (Down) | b ADEQUATE |
| (SMALL) | (Down) | c SHORT |
| (MEDIUM) | (Up) | a EXCESS |
| (MEDIUM) | (Up) | b ADEQUATE |
| (MEDIUM) | (Up) | c SHORT |
| (MEDIUM) | (Flat) | a EXCESS |
| (MEDIUM) | (Flat) | b ADEQUATE |
| (MEDIUM) | (Flat) | c SHORT |
| (MEDIUM) | (Down) | a EXCESS |
| (MEDIUM) | (Down) | b ADEQUATE |
| (MEDIUM) | (Down) | c SHORT |
| (LARGE) | (Up) | a EXCESS |
| (LARGE) | (Up) | b ADEQUATE |
| (LARGE) | (Up) | c SHORT |
| (LARGE) | (Flat) | a EXCESS |
| (LARGE) | (Flat) | b ADEQUATE |
| (LARGE) | (Flat) | c SHORT |
| (LARGE) | (Down) | a EXCESS |
| (LARGE) | (Down) | b ADEQUATE |
| (LARGE) | (Down) | c SHORT |

| $V_k$ | S | $V_k$ CORRECTION |
|---|---|---|
| (SMALL) | (LARGE) | a EXCESS |
| (SMALL) | (MEDIUM) | b ADEQUATE |
| (MEDIUM) | (LARGE) | b ADEQUATE |
| (MEDIUM) | (MEDIUM) | b ADEQUATE |
| (LARGE) | (LARGE) | b ADEQUATE |
| (LARGE) | (MEDIUM) | c SHORT |

Fig. 6B

| RESULT | DECISION & PROCESSING |
|---|---|
| | MORNING CYCLE (PASS 2ND UNCONDITIONALLY) |
| 0 | CONSUME TONER → CORRECT $V_k$ → DETECT $V_{min}$ |
| 1 | NO OPERATION (M.S. END) |
| 2 | CORRECT $V_k$ → DETECT $V_{min}$ |
| 3 | CORRECT $V_k$ → DETECT $V_{min}$ |
| 4 | SUPPLY TONER → CORRECT $V_k$ → DETECT $V_{min}$ |
| 5 | CORRECT $V_k$ → DETECT $V_{min}$ |
| 6 | CORRECT $V_k$ → DETECT $V_{min}$ |
| 7 | SUPPLY TONER → DETECT $V_{min}$ |
| 8 | SUPPLY TONER → CORRECT $V_k$ → DETECT $V_{min}$ |
| 9 | CONSUME TONER → CORRECT $V_k$ → DETECT $V_{min}$ |
| 10 | CONSUME TONER → DETECT $V_{min}$ |
| 11 | CORRECT $V_k$ → DETECT $V_{min}$ |
| 12 | CORRECT $V_k$ → DETECT $V_{min}$ |
| 13 | LOAD $V_{min}$ |
| 14 | CORRECT $V_k$ → DETECT $V_{min}$ |
| 15 | CORRECT $V_k$ → DETECT $V_{min}$ |
| 16 | NO OPERATION (M.S. END) |
| 17 | NO OPERATION (M.S. END) |
| 18 | CONSUME TONER → CORRECT $V_k$ → DETECT $V_{min}$ |
| 19 | CONSUME TONER → CORRECT $V_k$ → DETECT $V_{min}$ |
| 20 | CONSUME TONER → CORRECT $V_k$ → DETECT $V_{min}$ |
| 21 | CORRECT $V_k$ → DETECT $V_{min}$ |
| 22 | LOAD $V_{min}$ |
| 23 | CORRECT $V_k$ → DETECT $V_{min}$ |
| 24 | CORRECT $V_k$ → DETECT $V_{min}$ |
| 25 | DISPLAY ERROR |
| 26 | CORRECT $V_k$ → DETECT $V_{min}$ |

ID CHECK
PRINT BUTTON ON ?
NUMBER OF TIMES(n) ≧ 1 ?
Vsg + CHECK
FIX TONER DENSITY
SENSE PATTERN BY PHOTOSENSOR
1.4 ≦ ID ≦ 2.0 ?
NO
YES
SELECT DECISION ITEM (I) ~ (IV) MATCHING NUMBER OF TIMES
TO CORRECT Vk ?
YES
NO
CORRECT BIAS

DEVELOPING CONDITION SET CONTROL
D
MEASURE $V_{sg}^{+}$ 5 TIMES
REPEAT OUTPUT OF TONE 1~7 SOLID PATTERN 5 TIMES
READ PHOTOSENSOR OUTPUTS ASSOCIATED WITH 1~7
(4-V1)x8 < (4-V7) ?
YES
NO
DETERMINE Vk1 IS SMALL
(4-V1)x3 > (4-V7) ?
YES
NO
DETERMINE Vk1 IS LARGE

Fig. 15A

| DATA | | |
|---|---|---|
| GRD (123) | GRD (4567) | $V_k$ CORRECTION |
| (SMALL) | (Up) | a EXCESS |
| (SMALL) | (Up) | b ADEQUATE |
| (SMALL) | (Up) | c SHORT |
| (SMALL) | (Flat) | a EXCESS |
| (SMALL) | (Flat) | b ADEQUATE |
| (SMALL) | (Flat) | c SHORT |
| (SMALL) | (Down) | a EXCESS |
| (SMALL) | (Down) | b ADEQUATE |
| (SMALL) | (Down) | c SHORT |
| (MEDIUM) | (Up) | a EXCESS |
| (MEDIUM) | (Up) | b ADEQUATE |
| (MEDIUM) | (Up) | c SHORT |
| (MEDIUM) | (Flat) | a EXCESS |
| (MEDIUM) | (Flat) | b ADEQUATE |
| (MEDIUM) | (Flat) | c SHORT |
| (MEDIUM) | (Down) | a EXCESS |
| (MEDIUM) | (Down) | b ADEQUATE |
| (MEDIUM) | (Down) | c SHORT |
| (LARGE) | (Up) | a EXCESS |
| (LARGE) | (Up) | b ADEQUATE |
| (LARGE) | (Up) | c SHORT |
| (LARGE) | (Flat) | a EXCESS |
| (LARGE) | (Flat) | b ADEQUATE |
| (LARGE) | (Flat) | c SHORT |
| (LARGE) | (Down) | a EXCESS |
| (LARGE) | (Down) | b ADEQUATE |
| (LARGE) | (Down) | c SHORT |

| $V_k$ | S | $V_k$ CORRECTION |
|---|---|---|
| (SMALL) | (LARGE) | a EXCESS |
| (SMALL) | (MEDIUM) | b ADEQUATE |
| (MEDIUM) | (LARGE) | b ADEQUATE |
| (MEDIUM) | (MEDIUM) | b ADEQUATE |
| (LARGE) | (LARGE) | b ADEQUATE |
| (LARGE) | (MEDIUM) | c SHORT |

Fig. 15B

| RESULT | DECISION & PROCESSING<br>MORNING CYCLE<br>(PASS 2ND UNCONDITIONALLY) |
|---|---|
| 0 | CONSUME TONER → CORRECT $V_k$ → DETECT $V_{min}$ |
| 1 | NO OPERATION (M.S. END) |
| 2 | CORRECT $V_k$ → DETECT $V_{min}$ |
| 3 | CORRECT $V_k$ → DETECT $V_{min}$ |
| 4 | SUPPLY TONER → CORRECT $V_k$ → DETECT $V_{min}$ |
| 5 | CORRECT $V_k$ → DETECT $V_{min}$ |
| 6 | CHANGE POINTER(−5)→SUPPLY TONER→CORRECT $V_k$→ DETECT $V_{min}$ |
| 7 | CHANGE POINTER(−5)→SUPPLY TONER→CORRECT $V_k$→ DETECT $V_{min}$ |
| 8 | CHANGE POINTER(−5)→SUPPLY TONER→ DETECT $V_{min}$ |
| 9 | CONSUME TONER → CORRECT $V_k$ → DETECT $V_{min}$ |
| 10 | CONSUME TONER → DETECT $V_{min}$ |
| 11 | CORRECT $V_k$ → DETECT $V_{min}$ |
| 12 | CORRECT $V_k$ → DETECT $V_{min}$ |
| 13 | LOAD $V_{min}$ |
| 14 | CORRECT $V_k$ → DETECT $V_{min}$ |
| 15 | CORRECT $V_k$ → DETECT $V_{min}$ |
| 16 | NO OPERATION (M.S. END) |
| 17 | NO OPERATION (M.S. END) |
| 18 | CHANGE POINTER(+5)→CONSUME TONER→CORRECT $V_k$→ DETECT $V_{min}$ |
| 19 | CHANGE POINTER(+5)→CONSUME TONER→CORRECT $V_k$→ DETECT $V_{min}$ |
| 20 | CHANGE POINTER(+5)→CONSUME TONER→CORRECT $V_k$→ DETECT $V_{min}$ |
| 21 | CORRECT $V_k$ → DETECT $V_{min}$ |
| 22 | LOAD $V_{min}$ |
| 23 | CORRECT $V_k$ → DETECT $V_{min}$ |
| 24 | CORRECT $V_k$ → DETECT $V_{min}$ |
| 25 | CORRECT $V_k$ → DETECT $V_{min}$ |
| 26 | CORRECT $V_k$ → DETECT $V_{min}$ |

BIAS CORRECT CONTROL
Vb → Vo (STANDARD)+Vbs + Vbk
S1
I ← 1
S2
Vk (I+1) ← Vk (I)
S3
I ← I + 1
S4
I = 8 ?
S5
NO
YES
|STANDARD Vsp -Vsp| < 0.1 ?
S6
NO
YES
Vk(1) ← STANDARD Vk
S7
DETECT Vk
S8
INPUT Vk (1)
S9

IMAGE FORMING METHOD AND APPARATUS FOR THE SAME

This application is a continuation of application Ser. No. 07/691,727, filed on Apr. 26, 1991, now abandoned.

BACKGROUND OF THE INVENTION

The present invention relates to an image forming method and an apparatus therefor and, more particularly, to a method and an apparatus applicable to a color copier using color toners for adequately controlling the amount of toner deposition on a photoconductive element, or image density. Still more particularly, the present invention is concerned with a method and an apparatus for controlling the bias for development in a color copier.

It is a common practice with a copier or similar image forming apparatus to position a reference pattern having a reference density in part of a platen for preventing the image quality from being degraded by, for example, the contamination of the background. The reference pattern is illuminated to form a corresponding visible reference pattern on a photoconductive element, while a photosensor reads the reference pattern. In the event that a document image is to be formed on the photoconductive element, the charge potential, the bias for development and the amount of exposure are corrected on the basis of the density level sensed by the photosensor. If the apparatus forms the reference pattern while maintaining the bias for development constant, the potential remaining on the element sequentially increases to accelerate toner consumption. Moreover, as the remaining potential of the photoconductive element rises to a given value, the density of the reference pattern reaches saturation to prevent the remaining potential from being accurately detected on the basis of the output of the photosensor. To detect the remaining potential accurately, a reference pattern may be formed by a bias which is corrected on the basis of the density level sensed immediately before, as disclosed in Japanese Patent Laid-Open Publication No. 142370/1988 by way of example.

The above-mentioned implementation, however, has a problem when applied to, for example, a full-color copier using color toners. Specifically, toners used with a full-color copier, especially cyan and yellow toners, cause a great amount of charge to deposit thereon, so that an image density cannot be accurately determined unless the toner density is increased. This is especially true in low-temperature low-humidity environments. When a two-component developer which is a mixture of toner and carrier is used, such a high toner density is apt to smear a developing sleeve. Should the toner be deposited on the developing sleeve, the charge thereof would cause the effective bias for development to deviate to thereby contaminate the entire background, resulting in poor image quality.

It has also been customary to provide the above-described type of apparatus with an implementation for accurately controlling the amount of toner deposition on the photoconductive element, i.e. , the density of a toner image. For example, a photosensor senses not only the density of the reference pattern but also the density of the non-image area of the photoconductive element. Two different densities so sensed are compared. The result of comparison is used to remove an error appearing in the photosensor output due to the scattering in the sensitivity of the photosensor itself, changes in characteristics due to temperature, and contamination or changes in the surface conditions of the photoconductive element, whereby the density of a toner image is maintained constant. This kind of implementation is taught in Japanese Patent Publication No. 14348/1988, for example.

Such a conventional implementation also has a problem when applied to a color copier, especially a color copier of the type using a laser beam. In a color copier using a laser beam, a photoconductive element has therein a layer for diffusing a laser beam so as to eliminate an interference pattern ascribable to multipath reflection. Therefore, most of the reflection from the photoconductive element is only the surface reflection which is weak. As a result, the level of sensed reflection is extremely susceptible to a change in reflectance ascribable to the aging, scratch or similar change in the surface condition of the photoconductive element. In this connection, a traditional photoconductive element implemented with selenium, for example, has an aluminum base which reflects light regularly by more than twenty times than the surface of the element, and the deterioration of surface reflection due to aging is substantially negligible.

Since the reflection from the photoconductive element having the above-mentioned diffusion layer is weak, the detected level is also susceptible to the scattering in the sensitivity and position of a photosensor. It is, therefore, difficult to maintain the density of a toner image constant. Another problem is that since a color toner does not sufficiently absorb infrared rays, the reflection rather increases when the photoconductive element is fully covered with the color toner. In this condition, the photosensor output undesirably has the minimum value, as shown in FIG. 20. As a result, the change in the photosensor output does not match the change in the amount of reflection from the photoconductive element. Regarding the photosensor, therefore, the actual amount of toner deposition is a bilevel function. Simple control which supplies a toner when the output level of the photosensor is higher than a reference value would practically fail to control the toner density when the developing ability is high. To eliminate this problem, the amount of toner deposition on the photoconductive element may be increased to prevent the image density from being lowered. This, however, relies on the operator's perception, i.e. , forces the operator to set a toner density while repeating test copying. This is not only time- and labor-consuming but also increases the number of defective copies.

As stated above, with an image forming apparatus of the type using color toners and a photoconductive element to be scanned by a laser beam, it is not practicable to effect constant control over the toner image density which does not depend on the reflection characteristic of the element.

SUMMARY OF THE INVENTION

It is therefore an object of the present invention to provide an image forming method which variably controls the bias for development and thereby maintains the effective bias constant relative to the charge potential of a photoconductive element, and an apparatus therefor.

It is another object of the present invention to provide an image forming method which in the correction of a bias for development sets up an adequate effective bias within a short period of time so as to avoid redundancy, and an apparatus therefor.

It is another object of the present invention to provide an image forming method which corrects the toner density rapidly without causing contamination to occur in the background and thereby insures high image quality, and an apparatus therefor.

It is another object of the present invention to provide an image forming apparatus which maintains, when use is made of a photoconductive element to be scanned by a laser beam and color toners, the density of a visible reference pattern used to sense an image density adequate despite the change in, for example, the reflection characteristic of the photoconductive element and thereby enhances image quality, and an apparatus therefor.

It is another object of the present invention to provide an image forming method which maintains the density of a visible reference pattern adequate even when output of a photosensor is sharply changed due to aging, and an apparatus therefor.

It is another object of the present invention to provide an image forming method which automatically detects the shift of the density of a visible reference pattern out of an adequate range and then sequentially selects different developing conditions to maintain the density adequate, and an apparatus therefor.

It is another object of the present invention to provide an image forming method which automatically detects the time for the replacement of a photoconductive element by checking the life of the element which effects the control over the density of a visible reference pattern.

An image forming apparatus of the present invention comprises a photoconductive element, a charger for charging the surface of the photoconductive element to a predetermined charge potential, an exposing device for exposing the charged surface of the photoconductive element by a predetermined quantity of light to electrostatically form a latent image thereon, a developing device applied with a predetermined bias for developing the latent image with a developer containing at least a toner, a sensor for sensing the density of a predetermined visible reference pattern formed on the photoconductive element, and a controller for changing at least one of the bias, the charge potential and the quantity of light in response to an output of the sensor. The controller controls an effective bias applied to the developing device such that the bias differs from the background potential of the photoconductive element by a small potential in a direction opposite to ordinary image formation as to the size, causes the developing device with the effective bias to develop a latent image on the photoconductive element, and variably controls the bias such that the output of the sensor remains constant.

BRIEF DESCRIPTION OF THE DRAWINGS

The above and other objects, features and advantages of the present invention will become more apparent from the following detailed description taken with the accompanying drawings in which:

FIGS. 6A and 6B show a specific table for practicing the present invention;

FIG. 15 shows another decision table for practicing the present invention;

DESCRIPTION OF THE PREFERRED EMBODIMENTS

Figure 1:
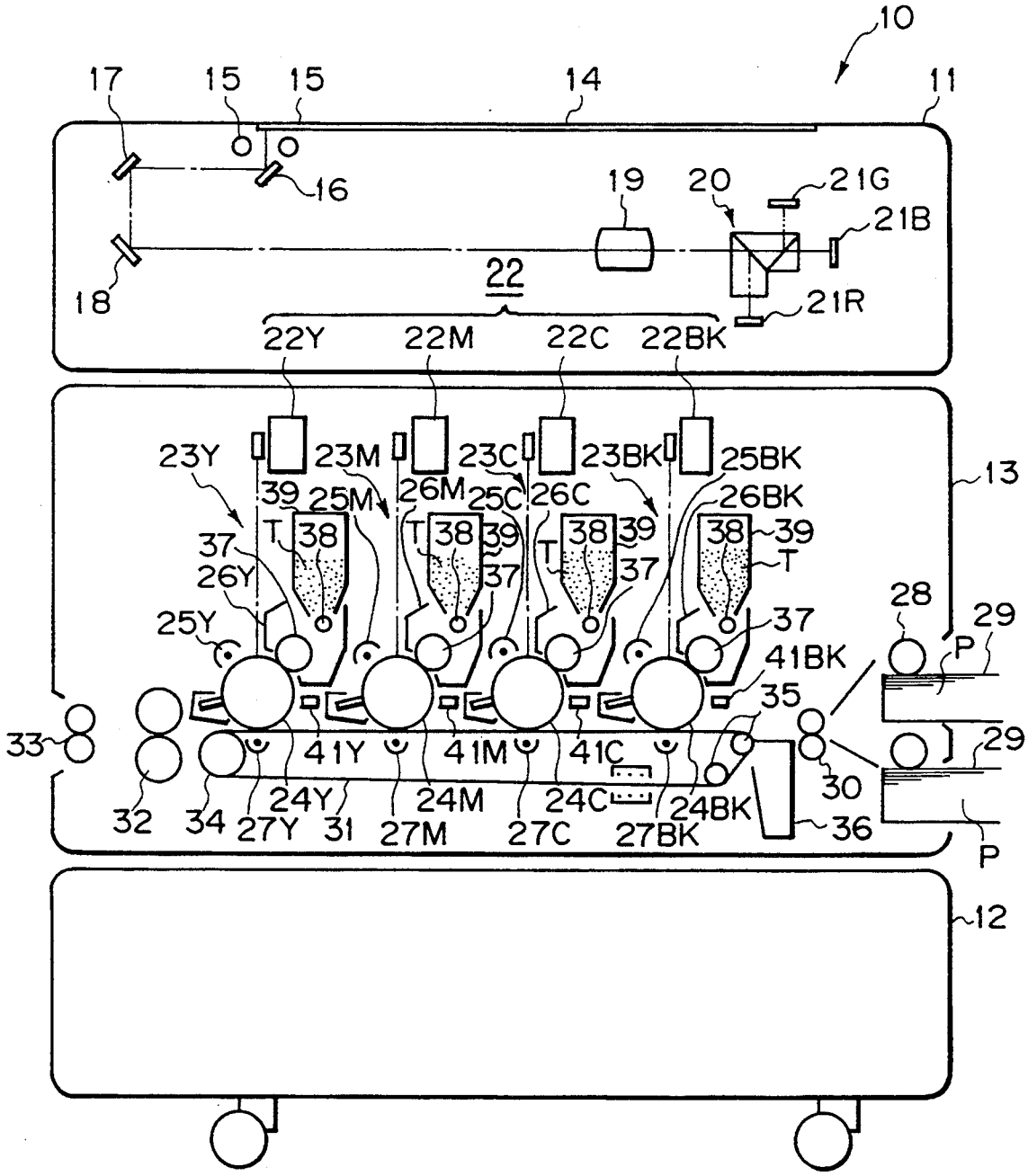
FIG. 1 is a view showing the general construction of a color copier belonging to a family of image forming apparatus and to which preferred embodiments of the present invention are applicable.

Referring to FIG. 1 of the drawings, a color copier belonging to a family of image forming apparatuses and to which the present invention is applicable is shown and generally designated by the reference numeral 10. As shown, the color copier 10 is generally made up of a scanner section 11 for reading document, an image processing section 12 for electrically processing a digital image signal outputted by the scanner section 11, and a printer section 13 for printing out an image in response to image signals of different colors fed from the image processing section 12.

Figure 16:
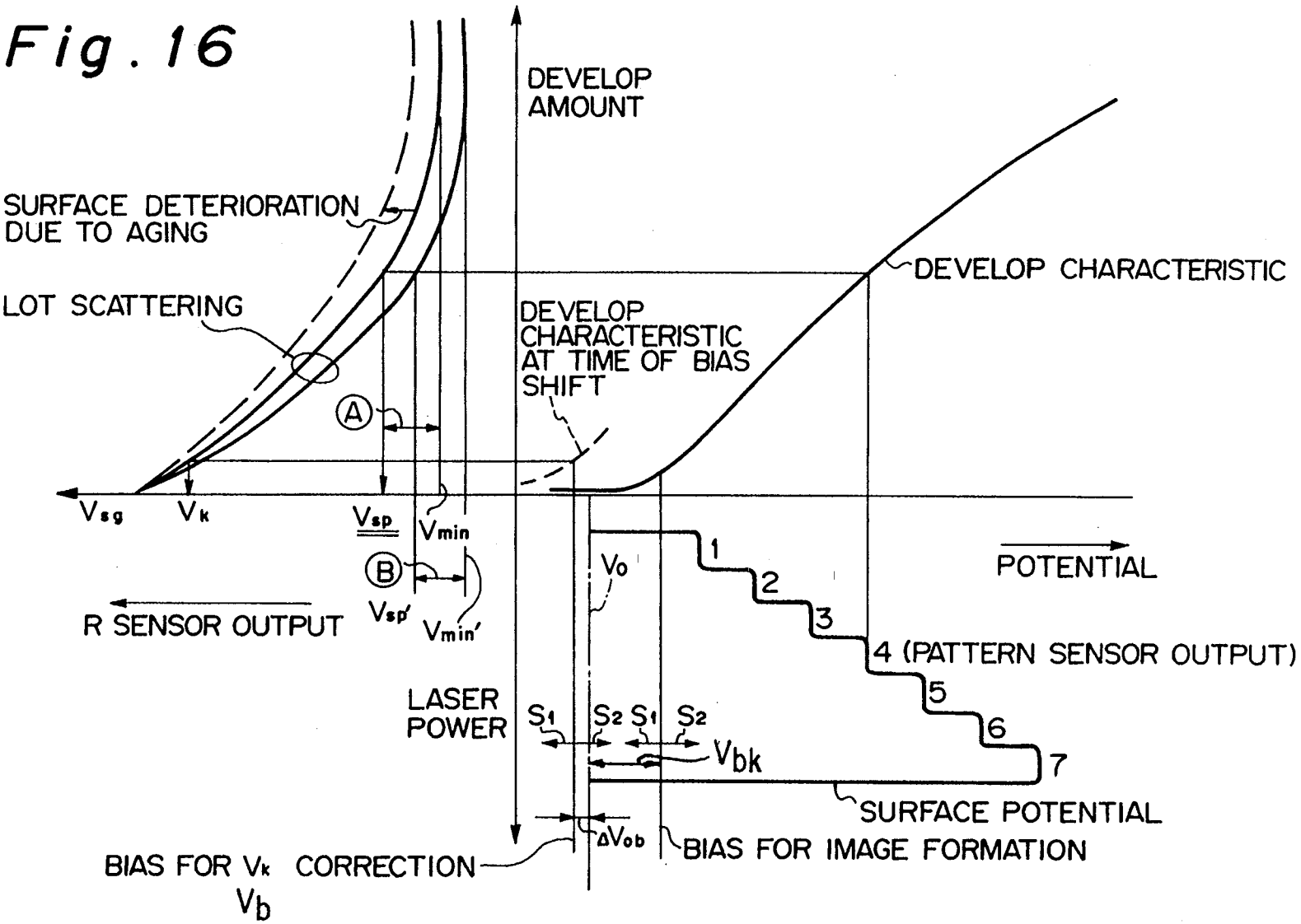
FIG. 16 is graph useful for understanding the control effected by the control section.

The scanner section 11 has lamps 15 for illuminating a document laid on a glass platen 14. An imagewise reflection from the document is sequentially reflected by mirrors 16, 17 and 18 to be incident to a lens 19. The lens 19 focuses the incident imgewise light onto a dichroic prism 20. The prism 20 separates the light into, for example, red, (R) , green (G) and blue (B) components each having a particular wavelength. These three color components R, G and B are incident to CCD (Charge Coupled Device) image sensors 21R, 21G and 21B, respectively. In response, the CCD image sensors 21, 21G and 21B each converts the incident light component R, G or B to a digital signal and feeds the digital signal to the image processing section 12. Processing such digital signals, the image processing section 12 produces data of, for example, yellow (Y), magenta (M), cyan (C) and black (BK) and delivers them to writing units (toner image forming means) 22Y, 22M, 22C and 22BK which are included in the printer section 13. The writing units 22Y, 22M, 22C and 22BK (or 22 collectively) emit laser beams carrying the image data of respective colors to recording units 23Y, 23M, 23C and 23BK, respectively. The recording units 23Y, 23M, 23C and 23BK are arranged at equally spaced locations on the same plane. The recording units 23Y–23BK are implemented with the same electrophotographic procedure although each is assigned to a different color. The recording unit 23C, for example, has a main charger 25C for uniformly charging a latent image carrier in the form of a photoconductive drum 24C to a potential corresponding to one of successive tones 0–7, as shown in FIG. 16. The laser beam issuing from the writing unit 22C and having been modulated by the image data irradiates the drum 24C to electrostatically form a cyan latent image thereon. Then, a developing unit 26C develops the latent image to produce a toner image.

The image processing section 12 controls the operations of various units and components of the printer section 13 according to a program stored in a memory which is built in the section 12. At the same time, this section 12 outputs signals for causing the writing units 22 to form visible reference patterns which will be described. To form a reference pattern, a charge potential corresponding to, for example, tone 4 shown in FIG. 16 is assigned to the drum 24C.

The printer section 13 has paper feeding means including a plurality of feed rollers 28. During the development, one of the feed rollers 28 feeds a recording medium in the form of a paper sheet P from a paper cassette 29 associated therewith to a register roller 30. The register roller 30 drives the paper sheet P toward the drum 24 at such a timing that the leading edge of the paper sheet P meets the leading edges of the toner images formed on the individual drums 24. As a transport belt 31 transports the paper sheet P to the left as viewed in the figure, toner images formed on the drums 24BK, 24C, 24M and 24Y are sequentially transferred to the paper sheet P to form a composite color image. The color image on the paper sheet P is fixed by a fixing roller 32 and then driven out of the copier 10 by a discharge roller 33. The belt 31 is held under predetermined tension by a drive roller 34 and a driven roller 35. Toner particles deposited on the belt 31 during the image transfer are removed by a cleaning unit 36.

Figure 3:
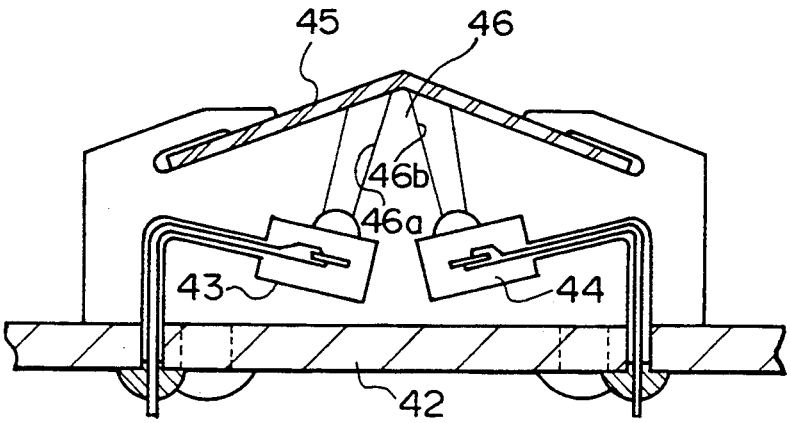
FIG. 3 is a section showing a specific construction of a photosensor included in the copier of FIG. 1.

The developing units 26BK–26Y (or 26 collectively) each has a developing sleeve 37, a toner supply roller 38, and a toner hopper 39 which stores a toner T therein. Each developing unit 26 also has an agitator, a group of stationary magnets, and a doctor blade, although not shown in the figure. The toner T in the hopper 39 deposits on the toner supply roller 38 by gravity. As the toner supply roller 38 rotates, it feeds the toner T toward the developing sleeve 37 while charging it by friction. The developing sleeve 37 in rotation transports the toner T toward the associated one of the drums 24BK–24Y (or 24 collectively). At this instant, the doctor blade, not shown, regulates the toner layer on the developing sleeve 37 to a predetermined thickness. The image processing section 12 variably controls a bias Vb applied to each developing sleeve 37. Reflection type photosensors 41Y, 41M, 41C and 41BK are associated with the drums 24Y, 24M, 24C and 24BK, respectively. The photosensors 41Y–41BK (or 41 collectively) each senses the amount of toner forming the reference pattern on the associated drum 24, i.e. , toner density (TC). As shown in FIG. 3, each photosensor 41 has a light emitting element 43 and a light-sensitive element 44 mounted on a printed circuit board (PCB) 42, a dust filter 45, and a casing 46 accommodating the elements 43 and 44 while supporting the dust filter 45. The casing 46 has tapered portions 46a and 46b. The outputs of the photosensors 41Y–41BK are fed to the image processing section 12. In response, the image processing section 12 changes at least one of the bias voltage applied to the developing sleeves 37, the charge potential which the main chargers 25 deposit on the drums 24, and the amount of light (amount of exposure) to issue from the writing units 22.

In operation, as the scanner section 11 outputs a digital image signal, the image processing section 12 electrically processes the digital image signal. The resulted image data of respective colors are transferred from the image processing section 12 to the printer section 13. As a result, the printer section 13 prints out a composite color image on the paper sheet P. By the same procedure, the image processing unit 12, writing units 22, main chargers 25 and developing units 26 cooperate to form predetermined visible reference patterns on the drums 24. The photosensors 41 each senses the reference pattern so formed on an associated one of the drums 24.

Figure 2:
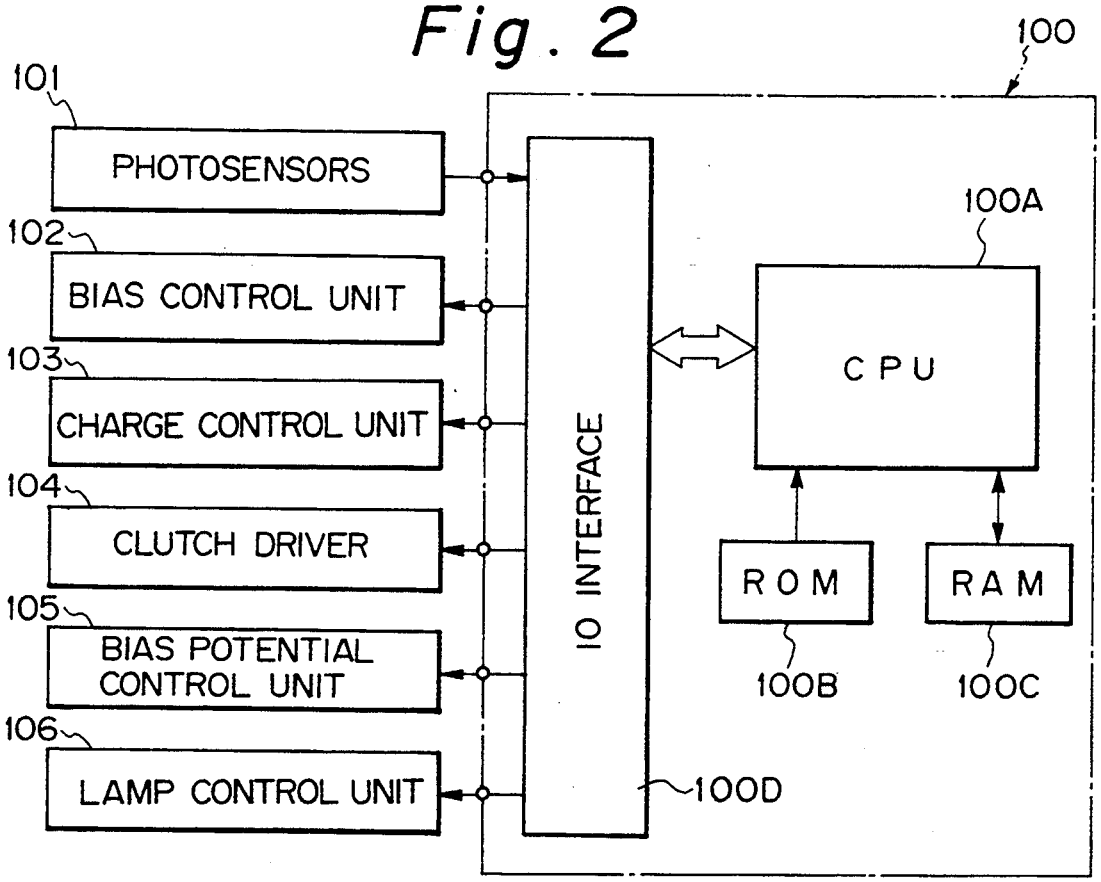
FIG. 2 is a block diagram schematically showing a control section incorporated in the copier of FIG. 1 for practicing the embodiments.

FIG. 2 shows a specific construction of a control section 100 constituting the image processing section 12. As shown, the control section 100 has a body 100A implemented by a micorocomputer for arithmetic and logical operations. Connected to the body 100A are a ROM 100B storing basic programs for executing arithmetic and logical operations, and a RAM 100C for storing various kinds of data. The external units are connected to the body 100 via an input/output (I/O) interface 100D. Specifically, photosensors 101 (corresponding to the photosensors 41BK–41Y, FIG. 1) are connected to the input side of the I/O interface 100D. Connected to the output side of the I/O interface 100D are a developing bias control unit 102, a charge control unit 103, a clutch driver 104 associated with the toner supply portions, a potential control unit 105 associated with the toner supply portions, and a lamp control unit 106.

The developing bias control unit 102 sets a bias potential to be applied to the toner on each developing sleeve 37 while the charge control unit 103 sets a charge potential to be deposited on the background of each drum 24. When the density of a reference pattern formed on a particular drum 24, i.e., the density Vsp of a solid image pattern is lower than a predetermined constant voltage Vspo, the clutch driver 104 drives a clutch to rotate a toner supply paddle, not shown. The bias potential control unit 105 sets a potential when a bias is applied to the toner to be supplied. The lamp control unit 106 controls the amount of light to issue from the lamps 15.

1st Embodiment

A first embodiment of the present invention shifts the bias voltage for development such that the output Vk of the photosensor 41 responsive to the reference toner image or pattern formed on the drum 24 remains constant, thereby maintaining the effective bias voltage for development constant relative to the charge potential on the drum 24. Let this kind of control be referred to as Vk control for simplicity hereinafter.

In this embodiment, the image processing section 12 controls the bias voltage of the developing unit 26 before or after an image forming operation. Specifically, as shown in FIG. 16, a bias Vb which differs from the background potential Vo of the drum 24 by a small amount $\Delta Vob$, e.g., about 1/5 or less of the image forming potential in the opposite direction to ordinary image formation with respect to the size is applied to the developing sleeve 37 of the developing unit 26, whereby a latent image is developed. In FIG. 16, the bias Vb indicated by a solid line is greater than the negative potential Vo. The bias Vb is shifted in a direction indicated by an arrow S1 or S2 such that the output Vk of the photosensor 41 responsive to the resulted toner image, i.e., a voltage sensed when the potential is small remains constant. The embodiment considers such a shift Vbs of the bias Vb as a difference between the effective bias and the output bias and adds it to the bias in the event of actual image formation. Specifically, considering the bias Vb to be the sum of a bias Vb (target value) which holds when the effective bias is not shifted and a value Vbs for cancelling the shift of the effective bias, the embodiment produces the shift of the effective bias by using the background potential Vo of the drum 24 as a reference, as follows:

$$V_b(\text{target}) + V_{bs} \quad (1)$$

$$Vb = Vo + Vbk \quad (2)$$

$$Vb = Vo + Vbk + Vbs \quad (3)$$

where Vo is the charge potential (background potential) of the drum 24, and Vbk is the shift from Vo to the Vk image forming potential (e.g. 24 volts).

Assuming that the output of the photosensor 41 under the above condition is Vk, shifting the bias Vb such that the sensor output Vk coincides with the target value Vko is successful in determining the deviation of the effective bias, i.e., an optimal shift.

In the illustrative embodiment, the running average of eight sensor outputs Vk is produced and compared with the target value Vko. When the difference between Vk and Vko is less than 0.1 volt (or 0.2 volt in the case of black), i.e.:

$$|Vk - Vko| < 0.1 \text{ volt} \quad (4)$$

the above control is not effected to eliminate the influence of irregularities in charging despite the fact that the $V_k$ image forming potential is as low as 24 volts. More specifically, assuming that the target potential of the reference pattern for the toner density TC control is Vtc, the target voltage for effecting a shift is Vko, and the n-th output of the photosensor 41 is Vsp (n) (TC control pattern sensed voltage) or Vk (n) (bias shift sensed voltage), the following relation holds for almost all values of n:

$$|Vsp(n) - Vtc| < 0.2 \text{ volt (or 0.4 volt for black)} \quad (5)$$

In this case, assuming that the running average of the bias shift sensed voltage Vk (n) is the shift Vk, the shift Vk is produced by, for example:

$$Vk = (1/8) \sum_{n=1}^{8} Vk(n) \quad (6)$$

On the other hand, when the toner density control is abnormal, the relation (4) is not satisfied, i.e., the following relation holds for each value of n:

$$|Vsp(n) - Vtc| < 0.2 \text{ volt (or 0.4 volt for black)} \quad (7)$$

Then, regarding n or n's with which the relation (7) holds, the target value Vko of Vk is substituted for Vk(n):

$$Vk(n) = Vko \quad (8)$$

Vk(n) is used to calculate the running average of the shifts Vk on the basis of the equation (6).

Further, in the illustrative embodiment, the Vk image forming potential shift Vbk is applied such that an electric field is developed in the forward direction, i.e., in the ordinary direction for developing a latent image, thereby reducing the influence of the reversely charged toner. This is because the forward electric field prevents the reversely charged toner from joining in the development. The Vk image forming potential Vbk is set at a level which causes a greater amount of toner than an ordinary small amount of non-charged toner to deposit, so that the influence of the contamination in the background of the drum 24 may be eliminated. Otherwise, when the background contamination is ascribable to the reversely charged toner and cannot be removed despite the increase in bias voltage, the bias shift will be increased endlessly. In addition, such a level of the Vk image forming potential shift Vbk is successful in freeing the photosensor 41 from errors.

When the actual toner density is deviated from the target toner density, i.e., Vsp shown in FIG. 16 is deviated from Vtc, the developing ability is lowered and, therefore, the sensed value of Vk is lowered. In such a case, the correction of Vk (shift of the bias Vb) is also reduced or, if the deviation is noticeable, the correction is not executed at all. Specifically, when the transition from the normal toner density control to the abnormal toner density control is under way, the amount of Vk correction is changed little by little. When the toner density is practically brought out of the expected range due to, for example, the failure in the detection of a toner end condition, the amount of correction is zero. However, simply when the ripple is noticeable (such as when the developer is fatigued and used under a hot and humid environment), the correction is effected although the degree thereof is small.

As stated above, this embodiment deposits a toner on the drum 24 by use of the bias Vb which differs from the background potential Vo of the drum 24 by a small potential in the opposite relation to the ordinary image formation as to the size, and shifts the bias Vb such that the output Vk of the photosensor 41 responsive to resultant toner image remains constant. Hence, the bias Vb remains constant relative to the charge potential Vo of the drum 24 to prevent the effective bias from being deviated, whereby the quality of a reproduced image is enhanced.

2nd Embodiment

This embodiment also relates to the Vk control.

Figure 21:
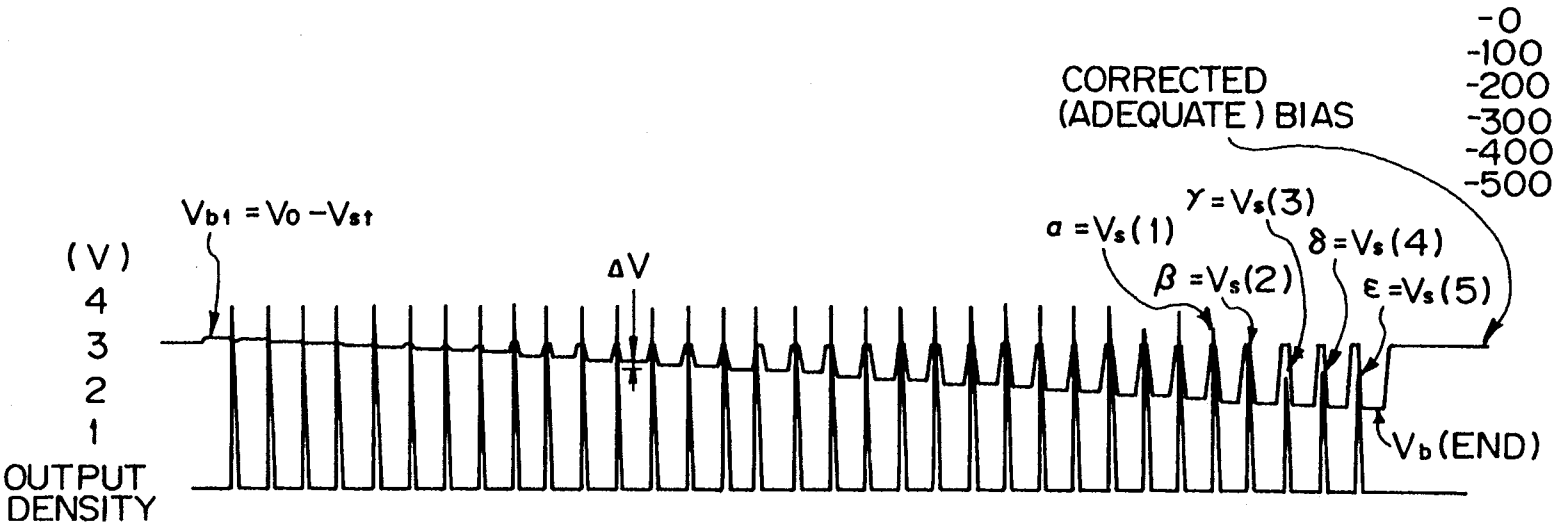
FIG. 21 plots a developing density characteristic achievable with the control section.

Specifically, as shown in FIG. 21, the initial bias Vbl for development is selected to be a predetermined shifted amounted Vst from the background potential:

$$Vbl = Vo - Vst \quad (9)$$

A reference pattern is formed on the drum 24 with a small potential difference (e.g. $\Delta = 8$ volts) from the initial bias Vbl ($Vbn = Vbl + (n-1) \cdot \Delta$), and then the density change of the reference pattern is sensed. The background contamination of the drum 24 is determined on the basis of the sensed density change.

Assume that the background potential of the drum 24 is Vsg when the background is free from contamination. Then, as indicated by symbols $\alpha$–$\epsilon$ in FIG. 21, when the peak which is 4 volts in, for example, a non-image area where a toner is absent, is lowered due to the above-mentioned shift of the bias, the mean value of five of the sensor outputs and the gradient of the outputs are produced by:

$$AVE = 1/5 \sum_{i=1}^{5} Vs(i) \tag{10}$$

When the density sensed by the photosensor 41 is identical with such an average value, the bias Vb is set at Vb (AVE). Assuming that the bias when the sensor output is Vs (5) is Vb (END), Vb (AVE) is determined, as follows:

$$Vb(AVE) = Vb(END) - 4 \times 8 \text{ volts}/2 = Vb(END) - 16 \text{ volts} \tag{12}$$

Assuming that Vb associated with Vko is Vb (Vko), then there holds an equation:

$$Vb(Vko) - Vb(AVE) = (AVE - Vko)/GRN \times 8 \tag{13}$$

Therefore, the shift of the bias is produced by:

$$Vbs = Vb(Vko) - (Vo + 48) = Vb(END) - 16 - + (AVE - Vko)/GRD \times 8 \tag{14}$$

The bias for development is corrected on the basis of the so determined shift and in the same manner as the equation (3), whereby the target bias is produced.

A specific operation of the illustrative embodiment will be described with reference to FIG. 22 which shows bias correction control.

Figure 22:
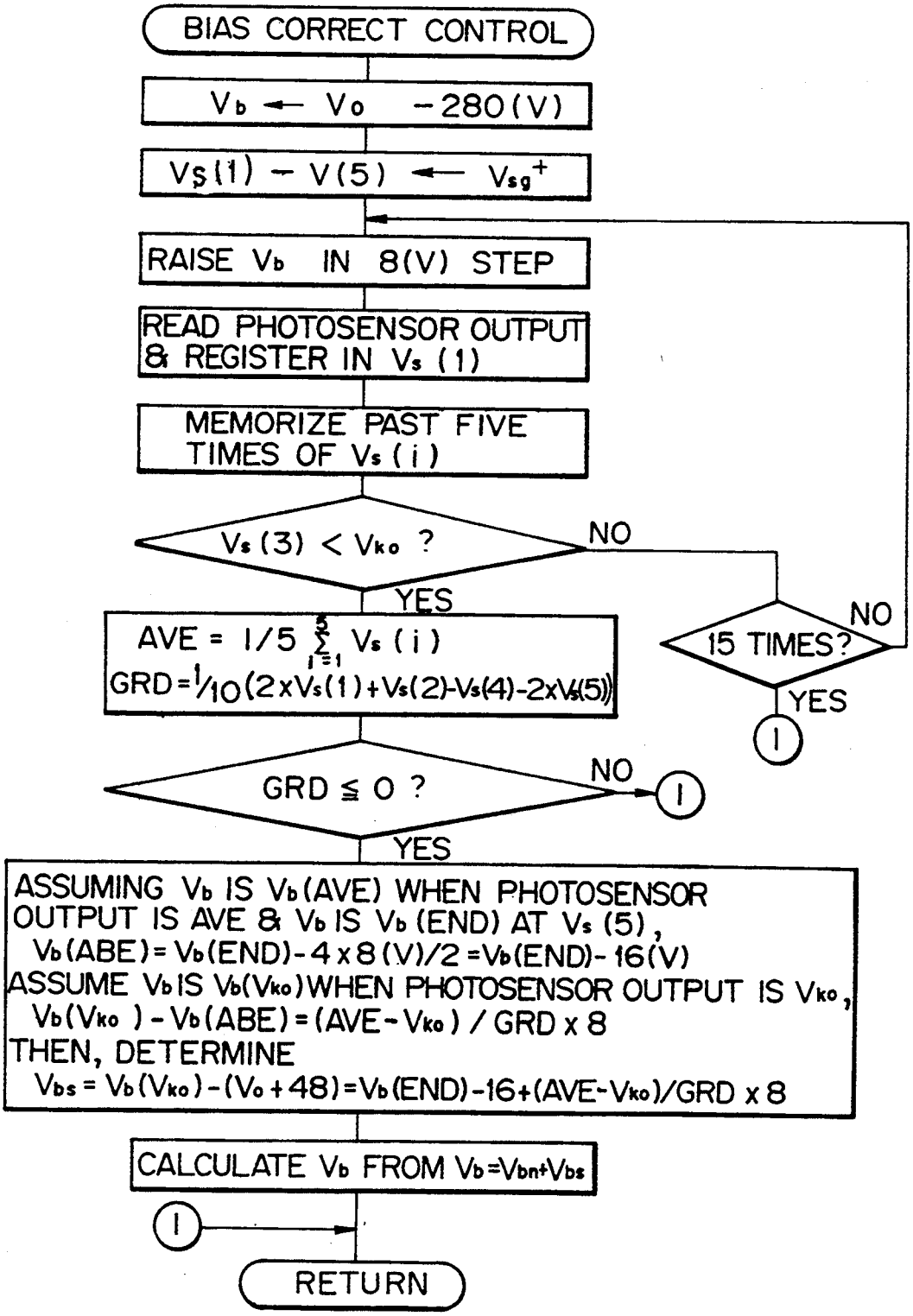
FIGS. 22 and 23 are flowcharts demonstrating other specific operations of the control section.

As shown in FIG. 22, the control section 100 subtracts a predetermined value from the background potential to set up an initial bias Vb for development. Density sensed potentials Vs(1)–Vs(5) between images are controlled to the background potential of the drum 24 when the drum 24 is moved and the developing sleeve 37 is held in a halt. In this condition, the bias is sequentially shifted over the step of 8 volts while, at the same time, the density sensed potentials of the reference patterns are detected. The density sensed potential Vs(1) detected when the background potential is lowered, for example, is determined to be the sensed value, and five sense outputs having appeared in the past are memorized. As shown in FIG. 21, the stepwise shift of the bias has influence on the change in the background potential. Specifically, the bias is so set as to increase the amount of toner deposition on the drum 24, and whether or not such a bias matches the control over the toner deposition is determined.

Then, the controller 100 determines whether or not the third or intermediate sensed potential Vs(3) is smaller than the target value Vko. If the sensed potential Vs(3) is greater than the target value Vko, whether or not the detection has been executed a predetermined number of times is determined. This is followed by processing matching the result of the decision. If the sensed potential Vs(3) is smaller than the target value Vko, the controller 100 determines that the bias needs correction and then executes necessary processing. Specifically, the control section 100 determines the mean value and the gradient of the sensed outputs by using the equations (10) and (11). If the sensed outputs have a gradient, the control section 100 calculates a shift of the bias and then corrects the bias by the equation (3).

In the above-described control, a toner is deposited on the drum 24 by the bias Vb having a predetermined potential difference from the background potential Vo of the drum 24 in the opposite relation to the ordinary image formation as to the size. The bias Vb is shifted such that the output Vk of the photosensor remains constant, whereby the bias Vb is maintained constant relative to the background potential Vo. At this instant, the deviation of the effective bias is corrected rapidly due to the above-stated potential difference, thereby enhancing the image quality.

3rd Embodiment

This embodiment pertains to the improvement in Vk control. The two embodiments described above shift the bias stepwise over a range of about 8 volts. This, however, is apt to increase the necessary correction time in which the effective bias will be reached and, when the ambient conditions change noticeably, apt to appear rather redundant in setting an optimal image density. This embodiment overcomes such a shortcoming.

Figures 23, 23A, 23B:
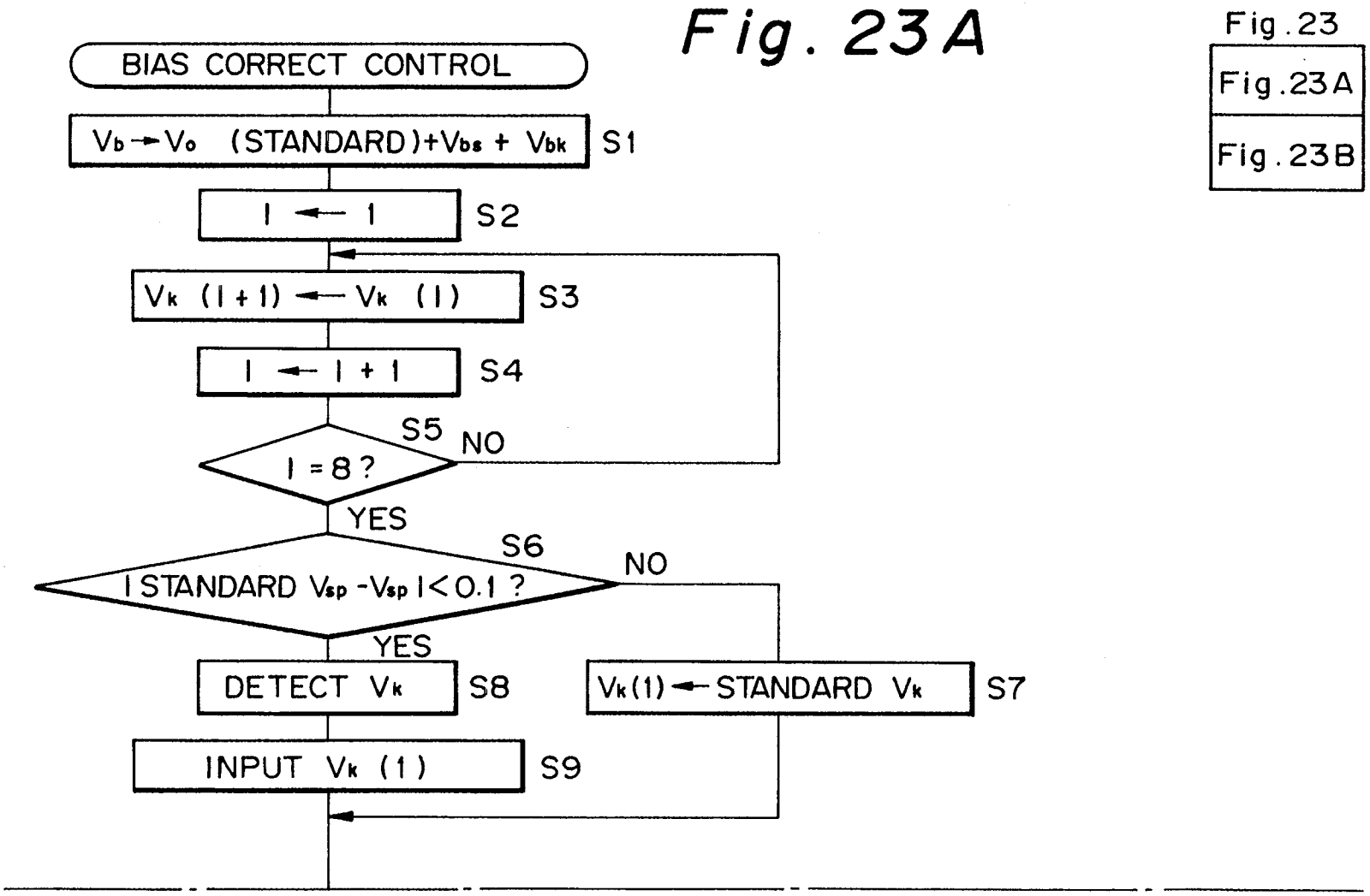
Figure 23B:
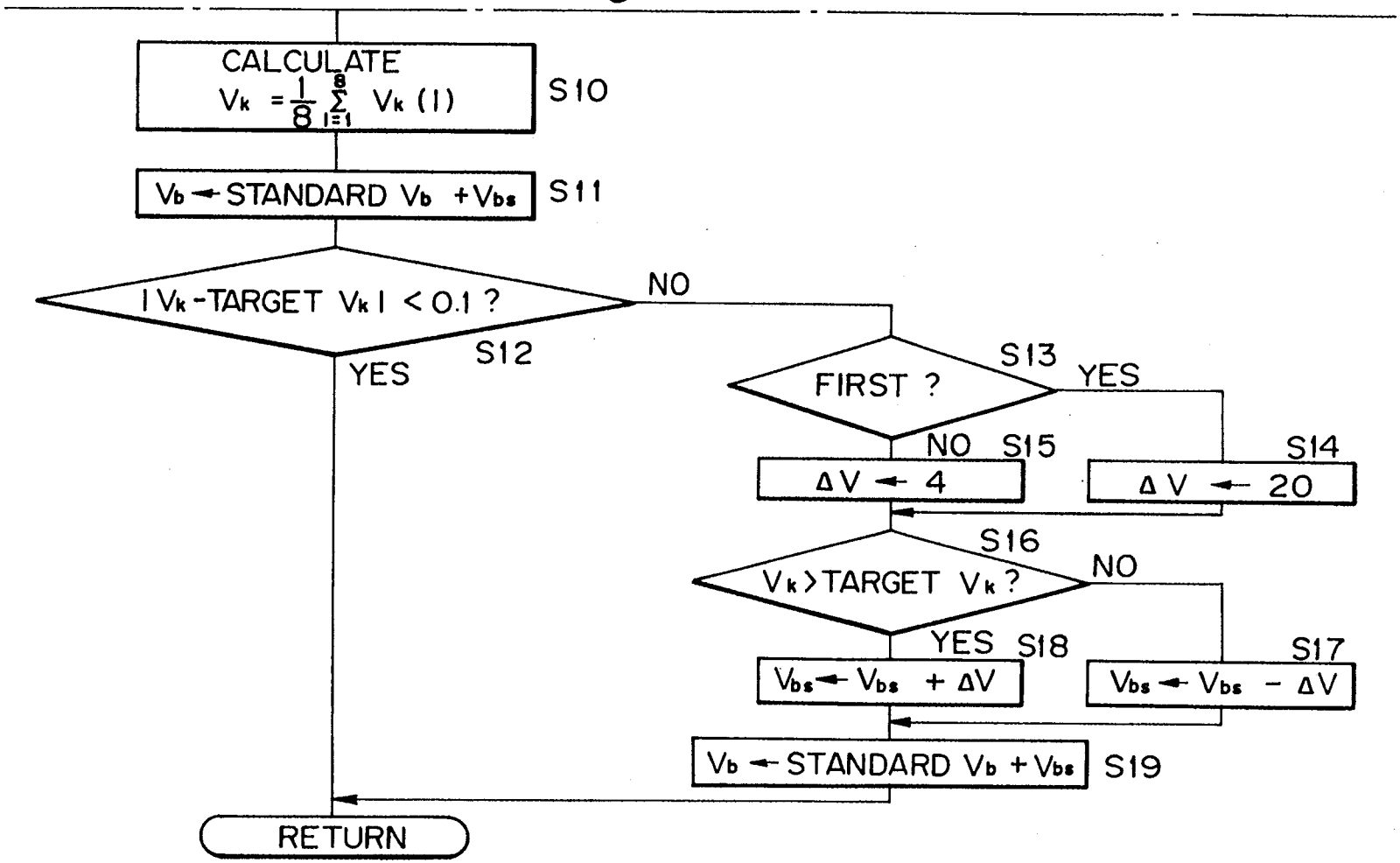
Figure 24:
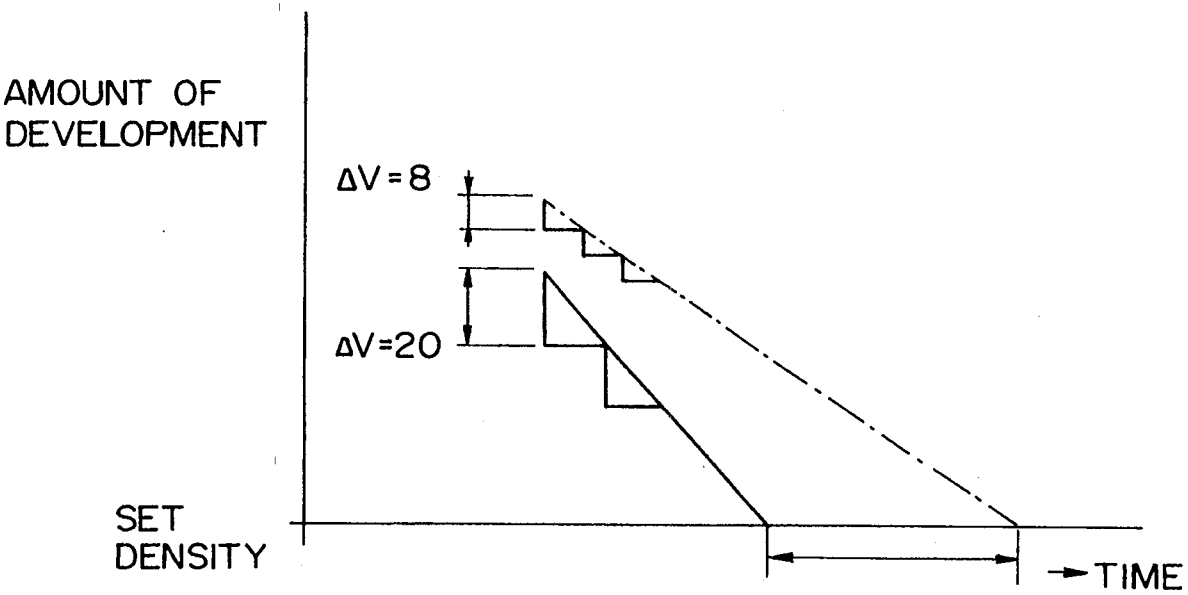
FIG. 24 is a graph representative of a developing density characteristic also achievable with the control section.

In this embodiment, the controller 100 executes the previously stated Vk control and, in addition, determines whether or not the image formation to be effected at the time of the correction of the effective bias is the first image formation and, if the answer is positive, increases the shift of the bias. Specifically, as FIG. 23 demonstrates, the controller 100 executes steps S1–S12 which pertain to the previously stated Vk control. In step S1, the controller 100 determines the bias Vb by using the equation (1), updates the initial bias, determines whether or not the updated bias has resulted from a plurality of output data from the photosensor, determines the density of the reference pattern associated with the above-mentioned bias, produces a mean value of eight consecutive outputs of the photosensor with the determined density, and then compares the mean value with the target value Vk. If the mean value is not equal to the target value Vk, the controller 100 determines whether or not the image formation is to be performed for the first time (S13). If the result of this decision is positive, the controller 100 selects a value greater than the small potential difference assigned to ordinary image formation (20 volts in the embodiment) (S14). As a result, as shown in FIG. 24, the stepwise change with respect to the set density is greater in the embodiment (solid line) than in the prior art (dot-and-dash line) so as to reach the set density rapidly. When the output of the photosensor 41 representative of the density of the reference pattern is greater than the target output, the shift of the bias is restored to original (S15–S18).

As stated above, this embodiment increases the shift of the bias and thereby changes the toner density at a higher rate. Executing such a procedure at the time of first image formation prevents the sharp change in density from being conspicuous.

4th Embodiment

This embodiment pertains to the control over the minimum value Vmin of the output voltage of the photosensor 41. Let this kind of control be referred to as "Vmin control". Specifically, as shown in FIG. 16, assuming that the minimum value Vmin of the output voltage of the photosensor 41 is Vmin, and that the dynamic range of the output voltage of the photosensor 41 is DR, then the dynamic range DR is expressed as:

$$DR = Vsg^{+} - Vmin \quad (15)$$

where Vsg+ is the mean value of the output voltages of the photosensor 41 associated with the background of the drum 24.

The dynamic range DR mainly depends on the regular reflectance of the drum 24, the irregular reflectance of the drum 24, the irregular reflectance of the toner, and the ratio between the areas of the photosensor 41 sensitive to regular reflection and irregular reflection. The dynamic range DR is apt to vary noticeably due to, among others, the scattering in the regular reflectance and the aging of the drum 24. On the other hand, the target value Vtc of the output voltage of the photosensor 41 (corresponding to the desired density of the reference pattern) is produced on the basis of the minimum value Vmin, as follows:

$$Vtc = Vmin + DR(TD + ND)/100 \quad (16)$$

where TD and ND are respectively the set toner density (4–34) and the amount of correction (0–7) in the event of background contamination.

Although the reflection by the surface of the drum 24 may slightly change, the pattern can be maintained constant if the target value Vtc has a predetermined ratio to the dynamic range DR. Specifically, as shown in FIG. 16, assume that two different reference patterns each having a particular reflection characteristic are formed on the drum 24, and the output voltages of the photosensor 41 representative of such patterns are Vsp and Vsp'. Then, if the minimum voltages associated with the two patterns are Vmin and Vmin' and if the values produced by dividing the potential differences (Vsp−Vmin) and (Vmin'−Vsp') by the individual dynamic ranges are constant, a constant developing characteristic can be insured therebetween. It is to be noted that a plurality of reference patterns may be formed to determine the minimum voltage Vmin by comparison.

Since the embodiment uses the drum 24 to which a laser beam is incident and uses a color toner, it brings about the following problems when implemented by the above-described Vmin detection principle:

(1) Simple comparison might result in underestimation since the individual sensed data often suffer from the unusual reflection characteristic of the drum 24 due to scratches or smears as well as from electric noise; and (2) Simple comparison might result in overestimation since the amount of toner deposited on the drum 24 is sometimes less than 1 mg/cm$^2$ even when a reference pattern is written by a lower toner density and by the maximum power.

In the case of a color toner, it is when the amount of toner deposited on the drum 24 is 1 mg/cm$^2$ that the output voltage of the photosensor 41 becomes minimum. If the toner density is coincident with the target density, the amount of toner deposition is the same as the amount achievable with the laser power of the writing unit 22 which renders tone 6 or 7.

The controller 100 determines the minimum voltage Vmin, as follows. First, the image processing section 12 causes the writing unit 22 to operate according to a predetermined program. In response, the writing unit 22 forms a plurality of, e.g., three or more reference patterns sequentially on the drum 24 with laser power lying in the range of tones 4–7. The resultant output voltages of the photosensor 41 associated with the individual reference patterns are fed to the image processing section 12. Then, the microcomputer built in the image processing section 12 executes regression by a quadratic on the basis of the voltages associate with all of the patterns and then produces the minimum voltage Vmin as the minimum thereof. The image processing section 12 determines the voltage data associated with the individual patterns written in tones 7, 6, 5, 4 and 3 to be V(0), V(1), V(2), V(3) and V(4), respectively, and produces intermediate functions by using V(X) (X=0, . . . , 4), as follows:

$$VXO = \sum_{X=0}^{4} (VX) \quad (17)$$

$$VX1 = \sum_{X=0}^{4} (VX) \cdot X \quad (18)$$

$$VX2 = \sum_{X=0} (VX) \cdot X \quad (19)$$

Then, the coefficients of the secondary regression equation are produced by:

$$H0 = (+62 \cdot VX0 - 54 \cdot VX1 + 10 \cdot VX2)/70 \quad (20)$$

$$H1 = (-54 \cdot VX0 + 87 \cdot VX1 - 20 \cdot VX2)/70 \quad (21)$$

$$H2 = (+10 \cdot VX0 - 20 \cdot VX1 + 5 \cdot VX2)/70 \quad (22)$$

When the next coefficient H2 is positive, i.e., when the regression line is downwardly convex, the minimum value Vmin is produced by:

$$Vmin = H0 - H1 \times H1/(4 \times H2) \quad (23)$$

If the coefficient H2 is negative, although the minimum value Vmin is not obtainable in the strict sense, it can be approximated by the nature of the sequence, as follows:

$$Vmin + H0 + 3 \times H1 \quad (24)$$

As stated above, taking advantage of the characteristic of a color toner, this embodiment detects the minimum value Vmin when the output of the photosensor 41 becomes minimum in association with the change in the amount of toner deposition the drum 24 and, therefore, accurately grasps the dynamic range of the output voltage of the photosensor 41. This maintains the developing characteristic constant and thereby insures a predetermined pattern density although most of the reflection from the drum 24 may be the surface reflection and therefore weak, the amount of reflection may change due to aging, or the sensitivity of the photosensor 41 may differ in sensitivity or position from one apparatus to another. As a result, an image forming apparatus of the type using a photoconductive drum operable to be scanned by a laser beam and a color toner can execute constant toner density control which does not depend on the reflection characteristic of the drum.

The control for setting the target image density Vtc by determining the minimum voltage Vmin as stated above has to detect the minimum value Vmin with utmost accuracy. For example, when the background potential Vsg is 4 volts and the minimum value Vmin is 1.5 volts, the detection error amounts to about 0.1 volt to 0.2 volt. Preferably, the allowable range of such errors should be about one-fifth of the above-mentioned value. Should the error of 0.1 volt to 0.2 volt occur, the target image density Vt would involve such an error and change noticeably, resulting in an excessive image density. Although the value TD for adjusting the target density Vtc in the equation (2) is adjusted to absorb the error, it is likely that such adjustment fails when the reflection characteristic of the drum surface changes due to aging. Specifically, when the error of the minimum value Vmin is substantial, the number of times that the minimum value is detected may be increased to produce a running average in order to enhance the accuracy. This, however, brings about another problem that on the sharp change in the minimum value Vmin, it is difficult to discriminate such a sharp change. Stated another way, if the target density is set simply on the basis of the detected reflection density involving an error and without checking the reflection density minutely, the resultant image density will be excessively high and result in overcorrection.

When the reflection density outputted by the photosensor indicates that the density of the actual reference pattern has temporarily reduced, the density is corrected on the basis of such a reflection density. In this case, after the reduced density condition have been remoed, the density is sometimes restored to the initially set target density with no regard to the surface conditions of the drum 24. Specifically, even when the drum has the background thereof contaminated and, therefore, has the reflection density lowered, the densisty correction is repeated as soon as the density correction is completed. Then, the density correction continues endlessly. More specifically, when the density of the toner image is detected on the bases of a sensor output representative of the highlight portion of the image, the sensed image density has no correlation with the actual density due to, for example, the change in the output of the writing system using a laser beam. Should the density be controlled on the basis of such a sensed image density, the correction would fail to match the actual condition.

In light of this, in the illustrative embodiment, the target value Vtc (corresponding to the desired pattern density) of the output voltage of the photosensor 41 which should be controlled is produced by using the minimum value Vmin and by changing the coefficients relating to the parameters of the equation (16), as follows:

$$Vtc = Vmin + DR(4 \cdot TD + 4 \cdot ND + 2 \cdot CD - 48)/400 \quad (25)$$

where TD is the toner density adjustment parameter (0–30), ND is the correcting term (0–7) derived from the detection of contamination, and CD is the value (16) preset in the event of shipment.

In this embodiment, in the equation (25), the minimum value Vmin which has a substantial error and causes the target value Vtc to noticeably change is fixed to, for example, a value preset at the time of shipment. Adjustment is executed with, among the other predetermined parameters, the value CD to change the target image density Vtc so as to control the correction of the image density. Specifically, the target value Vtc is used to adjust the reflection density of the reference pattern which is formed on the drum 24 by the same procedure as ordinary images, and the target value Vtc is determined beforehand. Whether or not the paramter set up to obtain the target value is adequate is determined on the basis of sensed outputs associated with a line pattern portion and a solid pattern portion which correspond to a highlight portion and a dark portion, respectively. If the parameter is not adequate, not the minimum value Vmin but another parameter, i.e., the value CD is adjusted to replace the target value with adequate one. In this particular embodiment, the value CD is selected from 0 to 2 and is 16 at first.

The controller 100 adjusts not only the value CD but also the correcting term ND ascribable to the background contamination and used to determine the target value Vtc. If the adjustment of the value CD is effected alone when, for example, the density of the reference pattern is deviated from the target value, the value CD will be restored to the preset target value as soon as the density of the reference pattern coincides with or becomes lower than the target value. Then, the value has to be readjusted when the pattern density is again deviated from the target value afterwards. In the embodiment, when such a procedure is repeated, e.g., when the controller 100 determines that the deviation of the target value due to background contamination is great without doubt, it adjusts the value ND associated with the reflection density of the drum 24 which has critical influence on image formation. As a result, the target value is fixed at the adjusted value until the next density correction occurs. This successfully reduces the number of times that the correcting procedure is repeated in the event of the next density correction. More specifically, when the density is determined to be low, for example, and if it is greatly different from the target value, not only the value CD but also, among the parameters used to determined the target value, the value ND is adjusted to fix the target value. This is successful in reducing the deviation at the time of the next density control.

Figures 4, 4A, 4B:
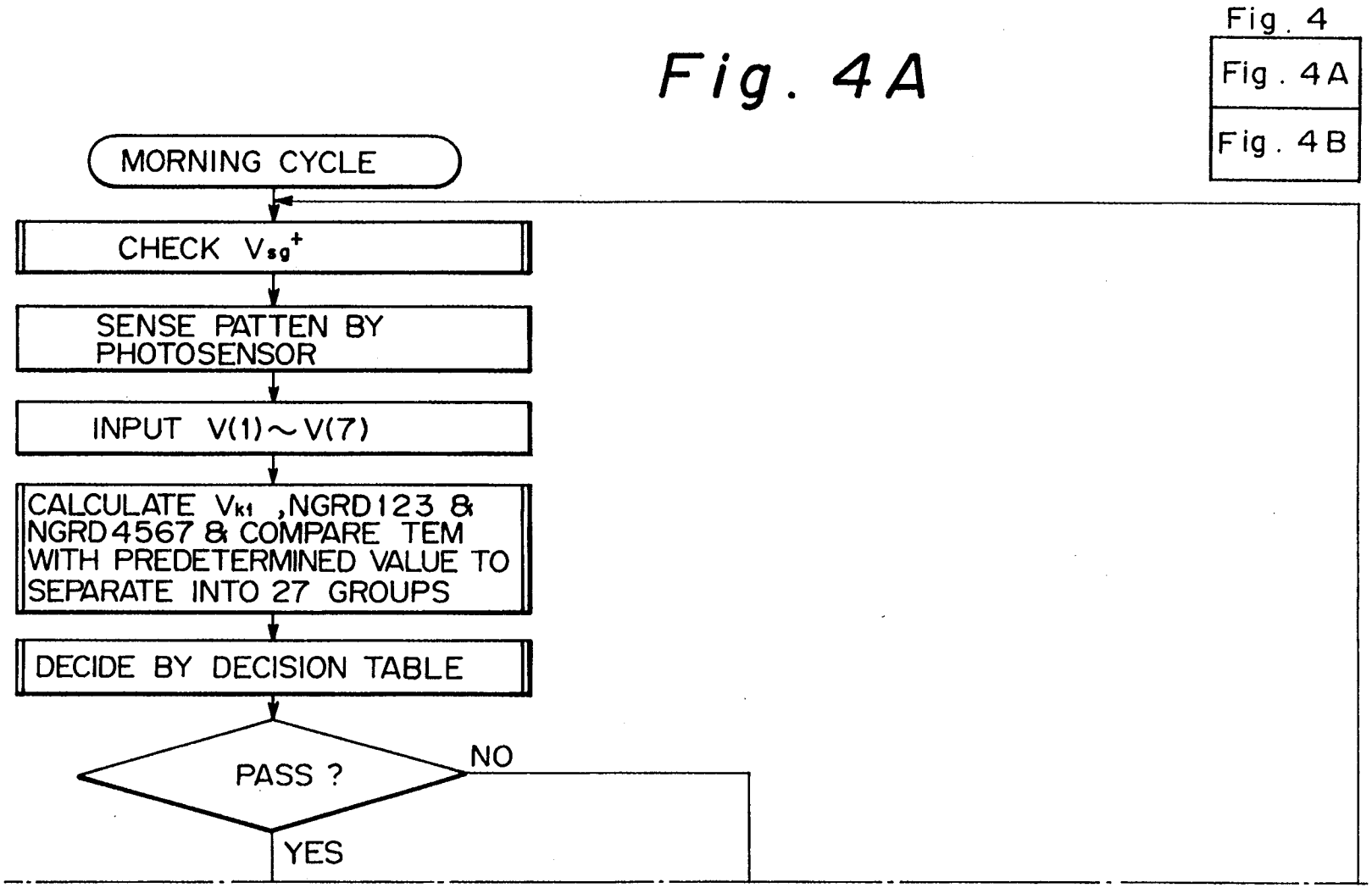
FIG. 4 is a flochart demonstrating a specific operation of the control section.
Figure 4B:
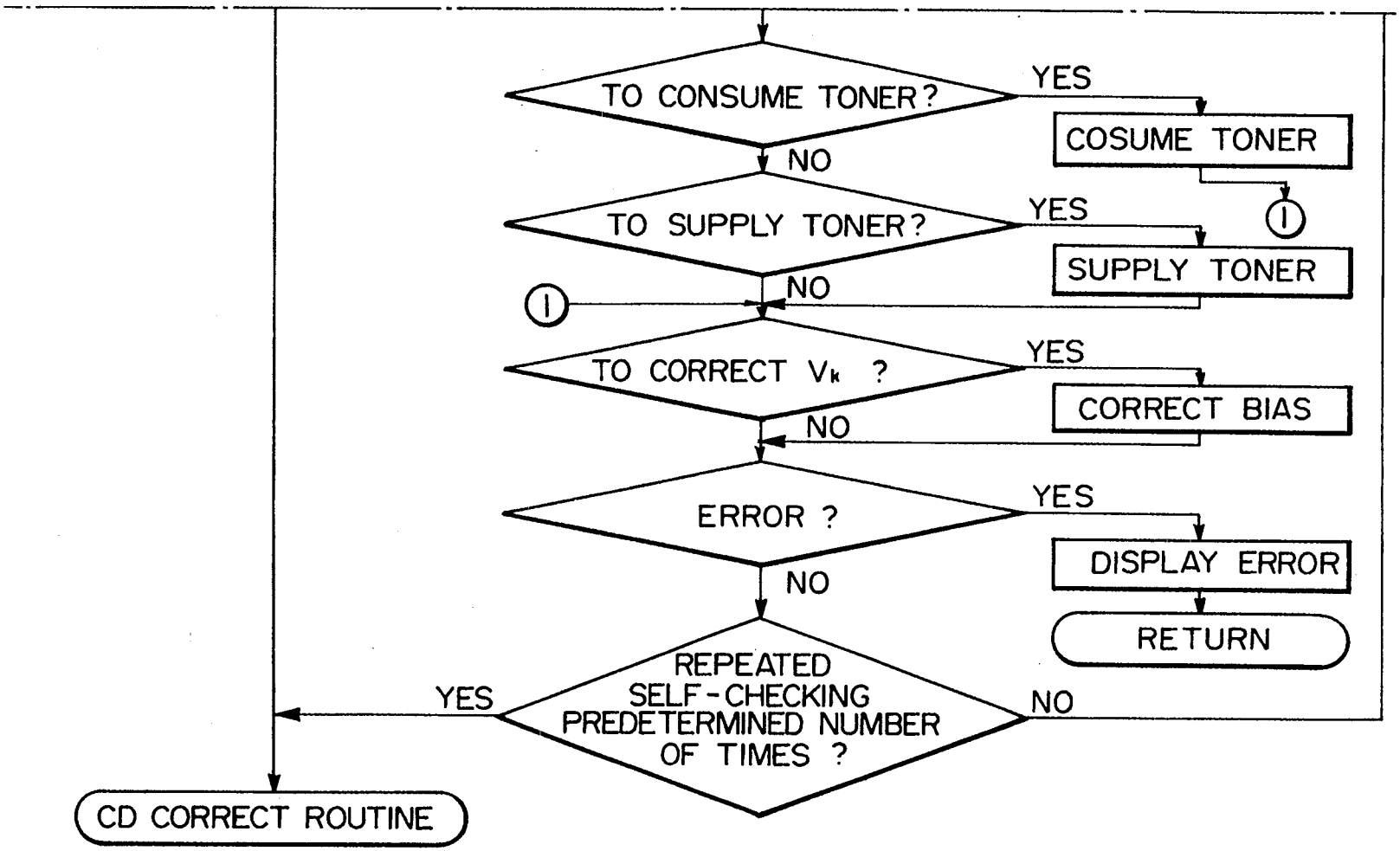
Figure 5:
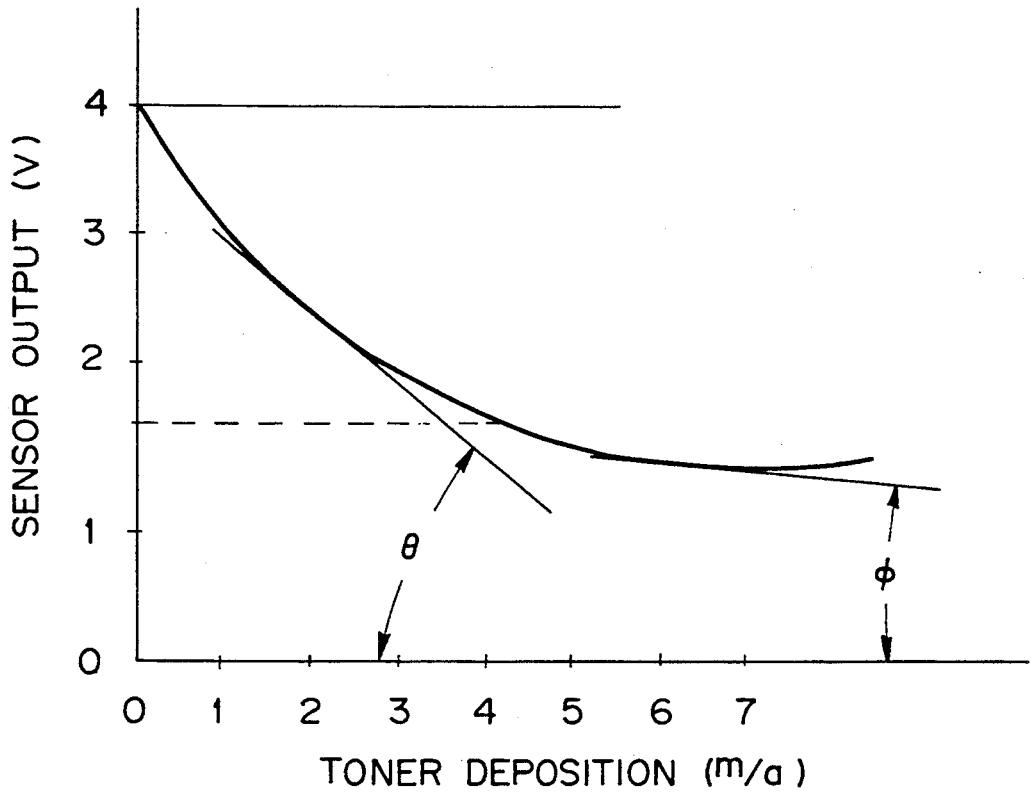
FIG. 5 is a graph indicative of specific conditions which the control section uses.

A reference will be made to FIG. 4 for describing a specific operation of the control section 100 of this embodiment. The sequence of steps shown in FIG. 4 is executed at the start-up of the copier, for example. When the drum 24 is rotated and the developing sleeve 26 is held in a halt, the surface potential or background potential Vsg+ the drum 24 is sensed. Subsequently, the densities sensed by the photosensor 41 in tones 0–7, i.e., the developing potential representative of a line pattern to the developing potential representative of a solid pattern are fed to the controller 100. In response, the controller 100 corrects the bias for development such that the output of the photosensor 41 remains constant, on the basis of the minimum value of the sensed outputs. At this instant, the control section 100 determines the current conditions of toner deposition represented by the change in the sensor output by self-checking, e.g., whether or not the control over the previously stated shift of the bias and over the toner supply is adequate. For this purpose, the controller 100 produces the gradient (GRD123$=\theta$) of the sensed values (V1–V3) in tones 0–3 and the gradient (GRD456$=\phi$) of the sensed values (V4–V7), i.e., the minimum gradient, as follows:

$$GRD123 = (V1 + 2 \cdot V2 - 3 \cdot V3)/4$$
$$NGRD = A \cdot GRD123/(4 - Vmin) \quad (26)$$

[where $A = 4(BK), 2.5(M, Y, C)$]

$$FRD4567 = (3 \cdot V4 + V5 - V6 - 3 \cdot V7)/10$$
$$NGRD123 = B \cdot GRD4567/(4 - Vmin) \quad (27)$$

[where $B-2(BK)$, 2.5 $(M,Y,C)$]

From such gradients, a characteristic value TGRD having correlation with the developing ability is produced by:

$$TGRD=NGRD123-10\cdot NGRD4567+1.0 \quad (BK,M)(28)$$

$$TGRD=NGRD123-10\cdot NGRD4567+2.0 \quad (Y)(29)$$

Using the characteristic value TGRD is significant in that should only the gradients of the sensor outputs be used, the change in the relation between the amount of toner deposition and the sensor output would not be linear to have the minimum value Vmin and the effective value of the bias would be affected by aging and ambient conditions. In the above equations, the coefficients associated with A and B are assigned to the toners of different colors, i.e., magenta (M), yellow (Y), and cyan (C) . The characteristic value so determined prevents the toner density from being cotnrolled in response to an output which does not match the actual amount of toner deposition of a highlight pattern.

Figure 7:
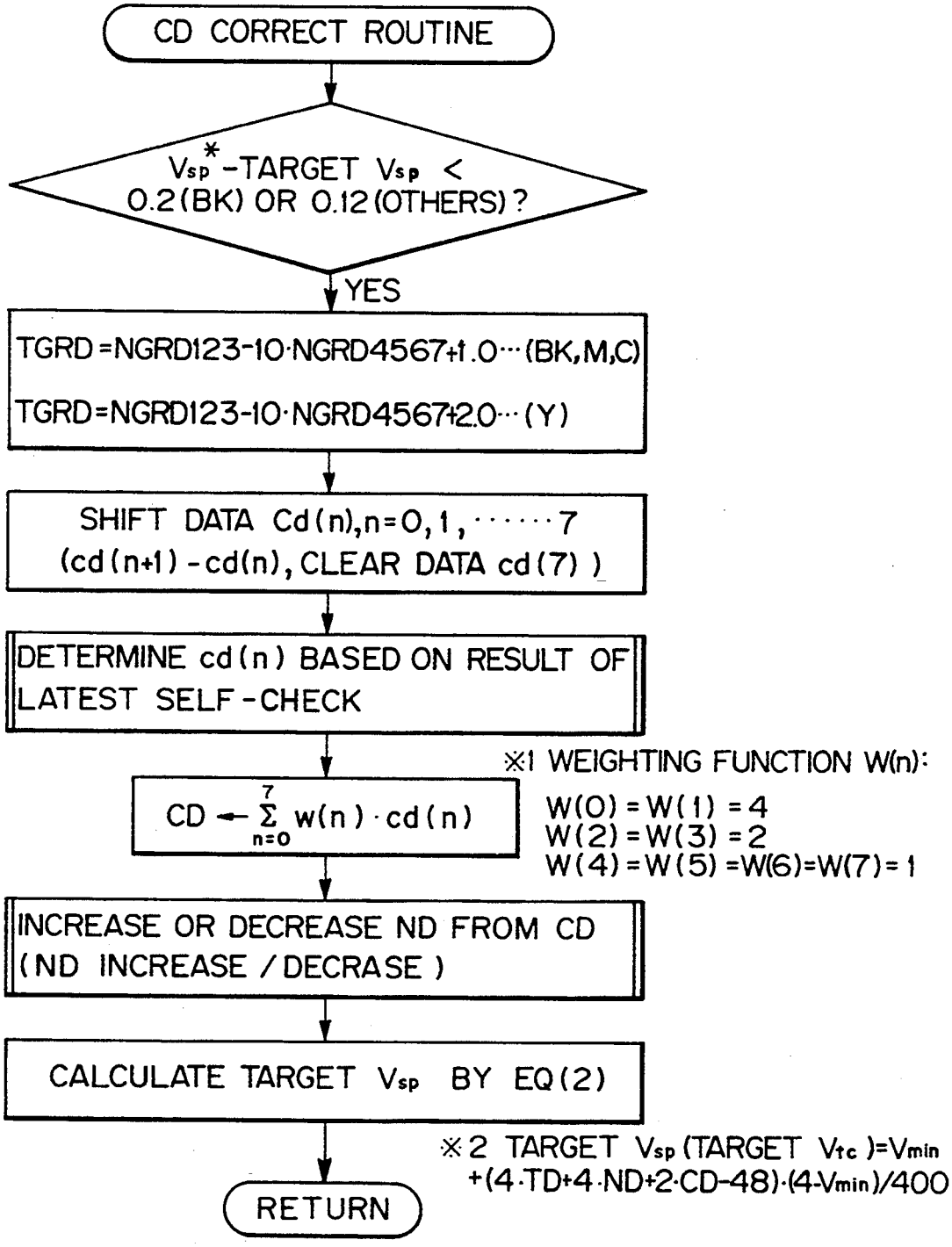
FIGS. 7 through 9 are flowcharts demonstrating specific operations of the control section.

The control section 100 determines whether or not the output of the photosensor 41 lies in a predetermined range with respect to the output corresponding to the target density of the reference pattern, and the condition of the bias for setting the sensor output (excessive, adequate or short). As FIG. 6A and 6B list, the results of this decision are classified into twenty-seven groups. The controller 100 executes, on the basis of the result of decision, a CD correction routine for determining the target value Vtc. As shown in FIG. 7, in the CD correction routine, a relation of the sensor output Vsp appearing when the result of decision is produced to the target sensor output (target Vsp) is determined to see if the toner density of the reference pattern is adequately controlled. Specifically, eight sensor outputs Vsp having been consecutively outputted in the past are averaged to produce a mean value Vsp*, as follows:

$$Vsp^* = (1/8)\sum_{i=1}^{8} Vsp(i) \quad (30)$$

Then, whether or not the mean value Vsp* lies in a predetermined range is determined:

$$Vtc-\delta(V)<Vsp^*<Vtc+\delta(V) \quad (31)$$

where $\delta=0.2$ volt (BK) or 0.12 volt (Y, M, C).

Figure 8:
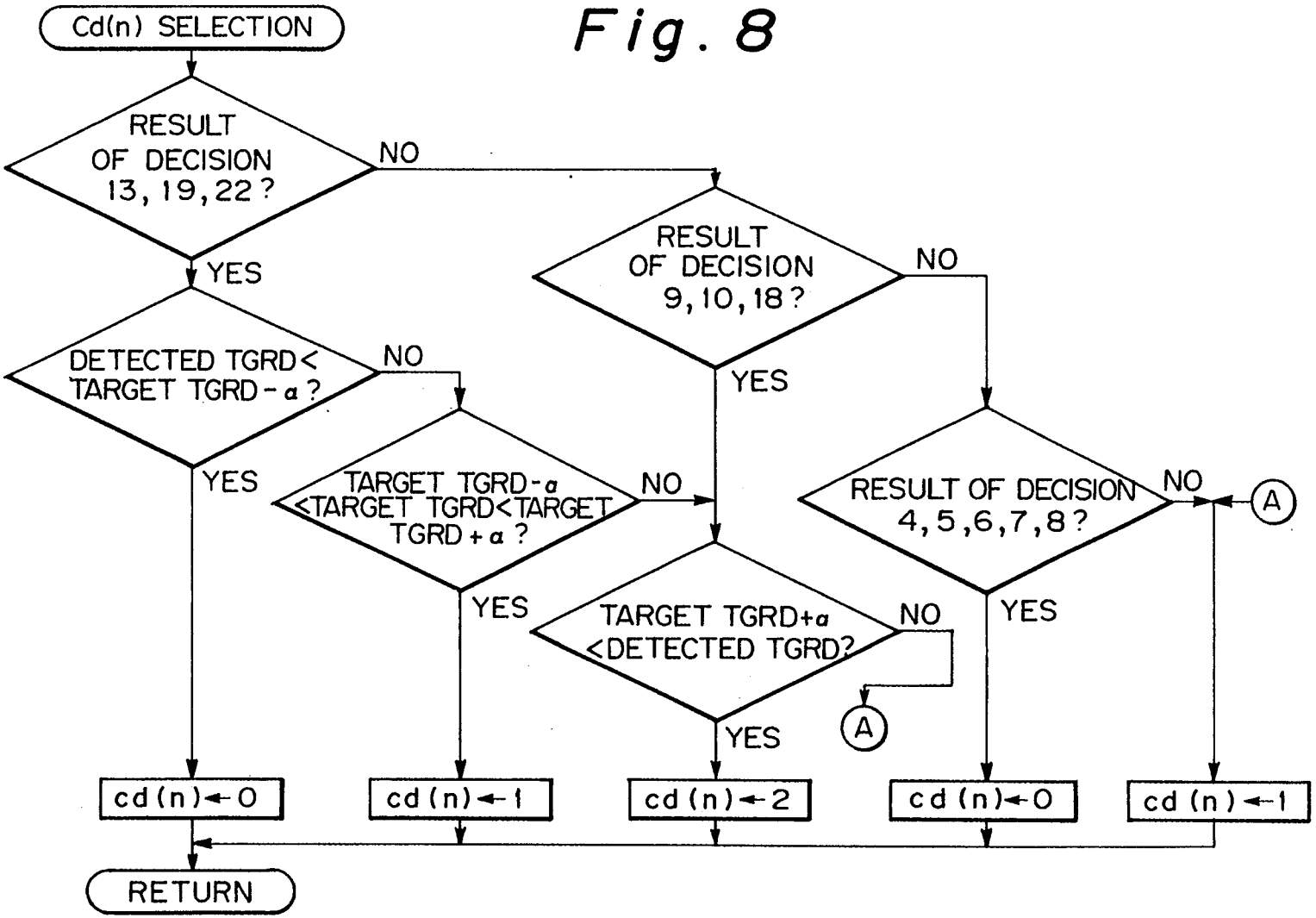

In this case, when the density control is determined to be not adequate, i.e., if the density is not lower than the above-mentioned predetermined value, the sensed output (target Vsp) matching the target density is not corrected. In the RAM 100C, cd (n) for determining the value CD are sequentially shifted on the basis of the result of self-checking and the characteristic relating to the gradients, whereby the value cd (7) is emptied. After this updating operation, "cd (n) selection" for selecting the value cd (n) is executed on the basis of the division of the result of the decision as shown by FIGS. 6A and 6B, and according to a procedure shown in FIG. 8. By the "cd (n) selection", the value cd (n) is selected with reference to the characteristic value TGRD and by use of comparative equations:

if detected TGRD<target TGRD−αcd(n)←cd(0)

if target TGRD−α<detected TGRD<target TGRD+αcd(n)←cd(1)

if target TFRD+α<detected TGRD cd(n)←cd(1)

Based on the so determined value cd (n), the value CD which is the parameter for determining the target density Vsp is produced by:

$$CD = \sum_{n=1}^{7} W(n)\cdot cd(n) \quad (32)$$

Figure 9:
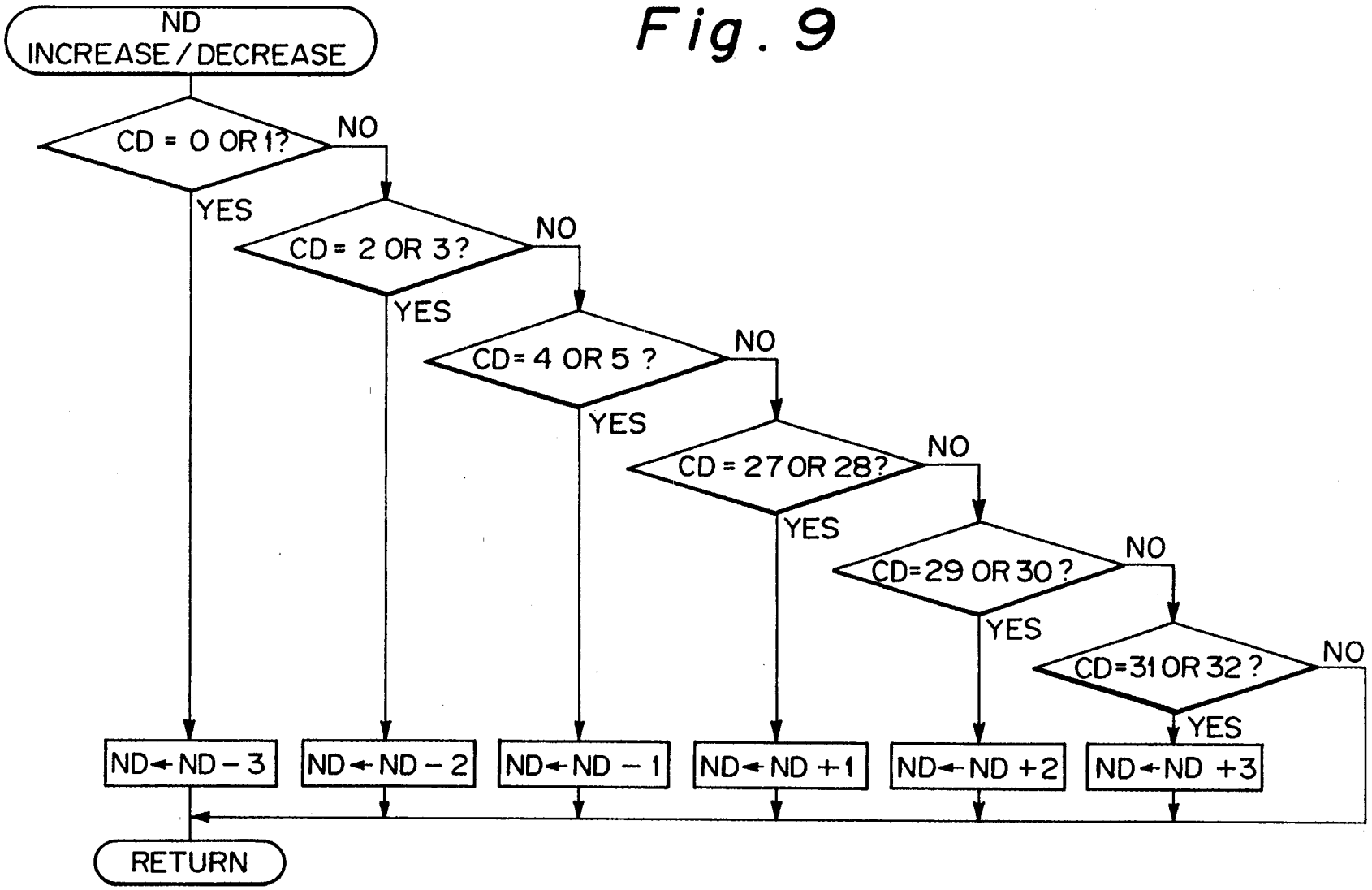

To determined the value CD, use is made of a weighting function w (n) for the following reason. Specifically, while the value CD is adjusted to either side of the predetermined value, i.e. , the value (16) set at the time of shipment in conformity to the change in the sensor output to in turn correct the target sensor output (target value Vsp). However, if the correction is so effected as to substantially equalize the target value and the current sensor output Vsp, the value is restored to original. In light of this, whether of not the target toner density matches the actual sensor output is determined on the probability basis. Specifically, assuming that the density is determined to be low, the repetition of such a decision allows the change in toner density to be determined on the probability basis. To perform such a decision, the embodiment uses the weighting coefficient and, when that the density is low is highly probable, executes, for example, processing for correcting the toner density ascribable to the background contamintion. As shown in FIG. 9, this processing is executed as "ND increase/decrease" in response to the calculated value CD. The correcting term ND is used to determine the sensor output Vtc representative of the target toner density. Even when the value CD is restored to the initial set value, the value is changed to fix the amount of correction in the event of determining the target density sensor output Vst. Even though the result of the next detection may cause the value CD to vary noticeably, the deviation for obtaining the target density sensor output Vst which is obtained from the change is reduced. The ND increase/decrease processing is effected by increasing a predetermined coefficient from the original value or decreasing the former from the latter. Hence, when the predetermined value for determining the target image density is adjusted, the target image density Vtc is updated by the equation (16). This updated value is held until the next self-checking occurs.

The illustrative embodiment corrects a predetermined parameter used to determine a target image density by sensing the image density on the drum. Alternatively, the same processing may be executed on the basis of the image density on a recording medium to which an image is transferred from the drum, as shown in FIG. 1. In such a case, the toner density will be sensed more accurately if the influence of the surface of the drum treated for irregular reflection on the photosensor is reduced.

As stated above, in following the change in the reflection from the refernce pattern ascribable to the deterioration of the drum surface or similar cause and, based on this change, setting a target or optimal image density, the above embodiment does not use, among the parameters usable to set the target density, the parameter which involves noticeable errors. The embodiment, therefore, prevents the target value of the corrected image density from being greatly changed. As a result, uncontrollable toner supply ascribable to excessive density correction is eliminated. For such processing, not only the sensor output representative of the highlight portion of the reference pattern but also the sensor output representative of a solid portion are used.

A sharp change in the reflection from the reference pattern due to, for example, the deterioration of the drum surface automatically follows. This allows the density to be corrected automatically and delicately.

The illustrative embodiment weights the result of the decision relating to toner supply control in place of effecting simple bidimensional toner supply control which uses a threshold value. Hence, the change in density is determined on the probability basis to promote adequate density control.

When the embodiment determines a target image density, it adjusts not only one parameter but also another parameter in conformity to the former. Even when one parameter is restored to the initial set value, the other parameter is fixed until the next image density control. Consequently, the deviation in the amount of correction for the image density which will be detected next is reduced.

Further, the embodiment eliminates erroneous density correction since it adjusts a predetermined value relating to density control after determining whether or not the sensed density of the toner image lies in a predetermined range with respect to data produced in the past.

Now, the minimum value Vmin sometimes varies with the ambient conditions in addition to the reflection characteristic of the drum. Especially, the developing ability which is determined by the amount of toner deposition on the drum is susceptible to temperature and humidity. It follows that the minimum value Vmin is apt to become unstable at the time of the start-up of the copier or similar situation, depending on the dynamic range relating to the bias, charge potential or the amount of exposure having been selected. Specifically, when a two-component developer which is the combination of toner and carrier is used, the developing characteristics and the background contamination sometimes vary with the ambient conditions, the number of copies, and the time and conditions in which the copier is left. Temperature and humidity, for example, cause the amount in which the toner and carrier absorb moisture to change, while the operating time causes the amount in which impurities deposit on the carrier to change as well as the amount of charge and discharge of the toner (and carrier). It follows that an adequate image density is not achievable if uniform conditions are used in forming images. Hence, when the target density of a reference pattern is to be set on the basis of the minimum value and if the minimum value is not stable, the switchover of the amount of correction has to be repeated until a sensor output matching the target density appears. Such processing is time-consuming and apt to result in a correction much removed 10 from the actual situation. For example, assume that the bias is corrected on the basis of the minimum value to allow the sensor output to remain constant (Vk control). Then, if the minimum value Vmin is determined when the density of the reference pattern is unusually high or unusually low to thereby set the shift of the bias or supply the toner, the toner density is apt to run out of control.

Figure 10:
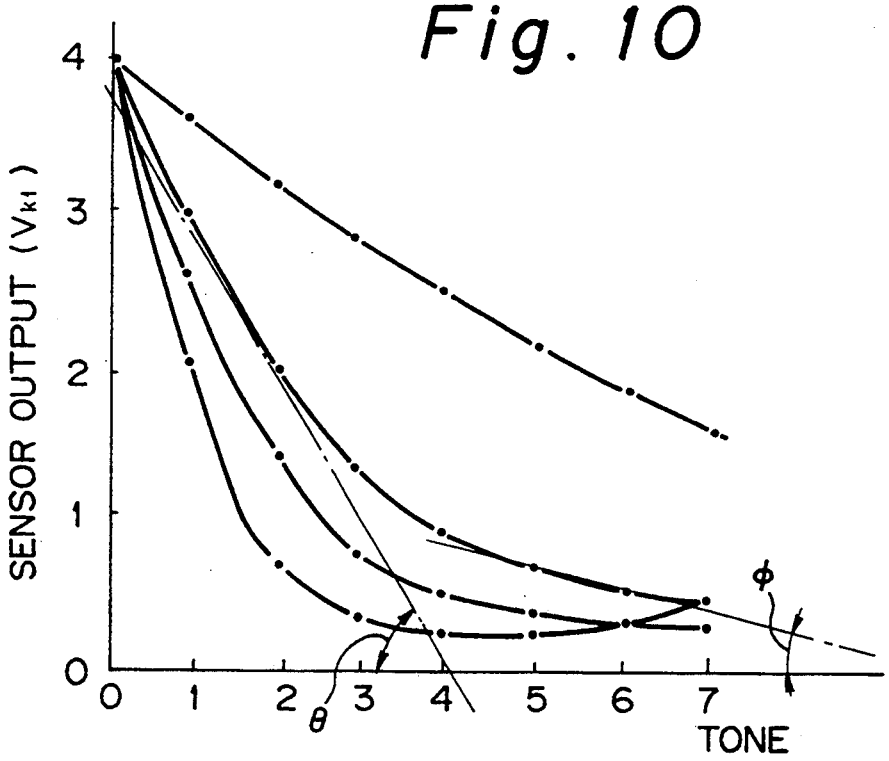
FIG. 10 is a graph showing conditions which the control section uses.

In light of this, the embodiment causes the control section 100 to examine by self-checking the current conditions of toner deposition, i.e., whether or not the control over the shift of the bias and the toner supply is adequate by referencing the change in sensor output. Specifically, in FIG. 10, the controller 100 determines the gradient $\theta$ of tones 0–3, the shift of the bias, the detected value in tones 4–7, i.e., the minimum gradient $\phi$. Then, the control section 100 determines whether or not the gradients lie in a predetermined range relative to the gradient of the sensor outputs which is associated with the target density of the reference pattern, and whether the shift of the bias for setting the sesor output which sets up such gradients is excessive, adequate, or short.

Further, to correct the change in the density of the reference pattern ascribable to a sharp change in the ambient conditions, for example, the embodiment sets up a constant toner density and then determines whether or not the sensor output lies in a predetermined range with respect to a standard density ID. Every time the image forming operation is completed, this decision is made with:

(a) bias for development;
(b) supply or consumption of toner;
(c) charge potential on drum;
(d) combination of (a) and (b);
(e) combination of (a) and (c); and
(f) combination of (b) and (c)

in this sequence regarding the dynamic range or the drive settings of the toner supply section. By so determining whether or not the dynamic range or the drive settings for the toner supply section are adequate with each of the parameters every time the image forming operation is performed, the embodiment optimizes, when the density of the reference pattern is brought out of the adequate range, the density by correcting the dynamic range or the drive of the toner supply section with respect to the parameter of that moment.

Figure 11:
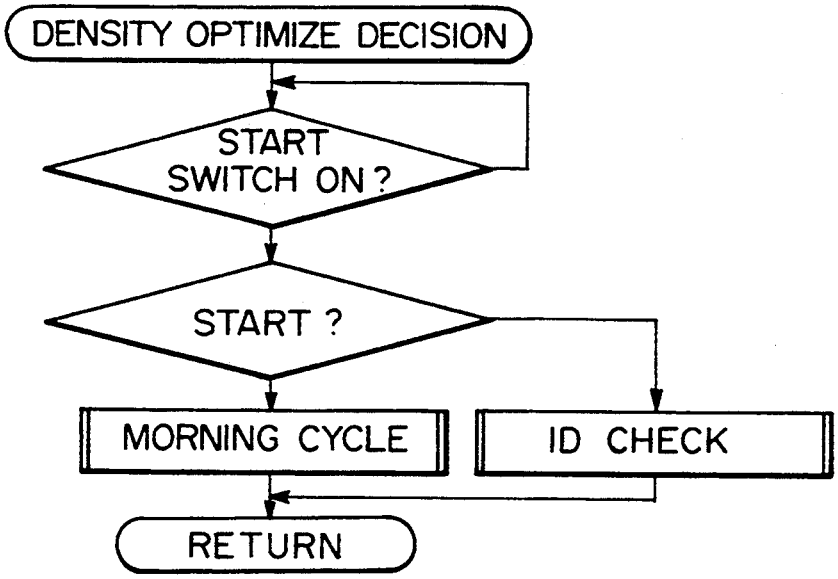
FIGS. 11 through 14 are flowchart representative of specific operations of the control section.

The operation of this embodiment, i.e., the controller 100 will be described with reference to FIG. 11. FIG. 11 shows specific processing which is executed after the start-up of the copier. As shown, the controller 100 determines whether or not the copier is in operation by referencing the on/off state of a start switch. If the start switch has been turned on, the controller 100 determines whether or not it has been turned on for the first time. If the switch has been turned on for the first time, meaning that the copier has just been started up, the control section executes a morning cycle shown in FIG. 4. In the morning cycle, while the drum is rotated with the developing sleeve being held in a halt, the controller 100 detects the surface potential or background potential Vsg+ of the drum. Then, on receiving the outputs of the photosensor, the controller 100 determines the minimum value of the sensor outputs by the equations (15)–(24) and the amount of correction Vk of the bias. Based on the results of equations (15)–(24), the controller 100 references the decision table, FIGS. 6A and 6B, to examine the current state of the minimum value, i.e., whether or not the toner density needs correction. If the amount of toner is excessive, the controller 100 causes the toner to be consumed on the drum by a method, not shown, and corrects the bias for development. Conversely, when the amount of toner is short, the controller 100 supplies the toner and corrects the bias for development. After such a procedure, the controller 100 calculates the minimum value Vmin again, stores is in the RAM 100B, and then awaits the next image forming operation.

In this manner, when the minimum value of the sensor outputs associated with the current reference pattern is changed with respect to the value corresponding to the standard reference pattern density, the controller 100 examines the condition of the minimum value and, even when the minimum value is not stable, effects toner control for forming an image. As a result, the toner density on the drum can be accurately controlled via the reference pattern density.

Figures 12, 12A, 12B:
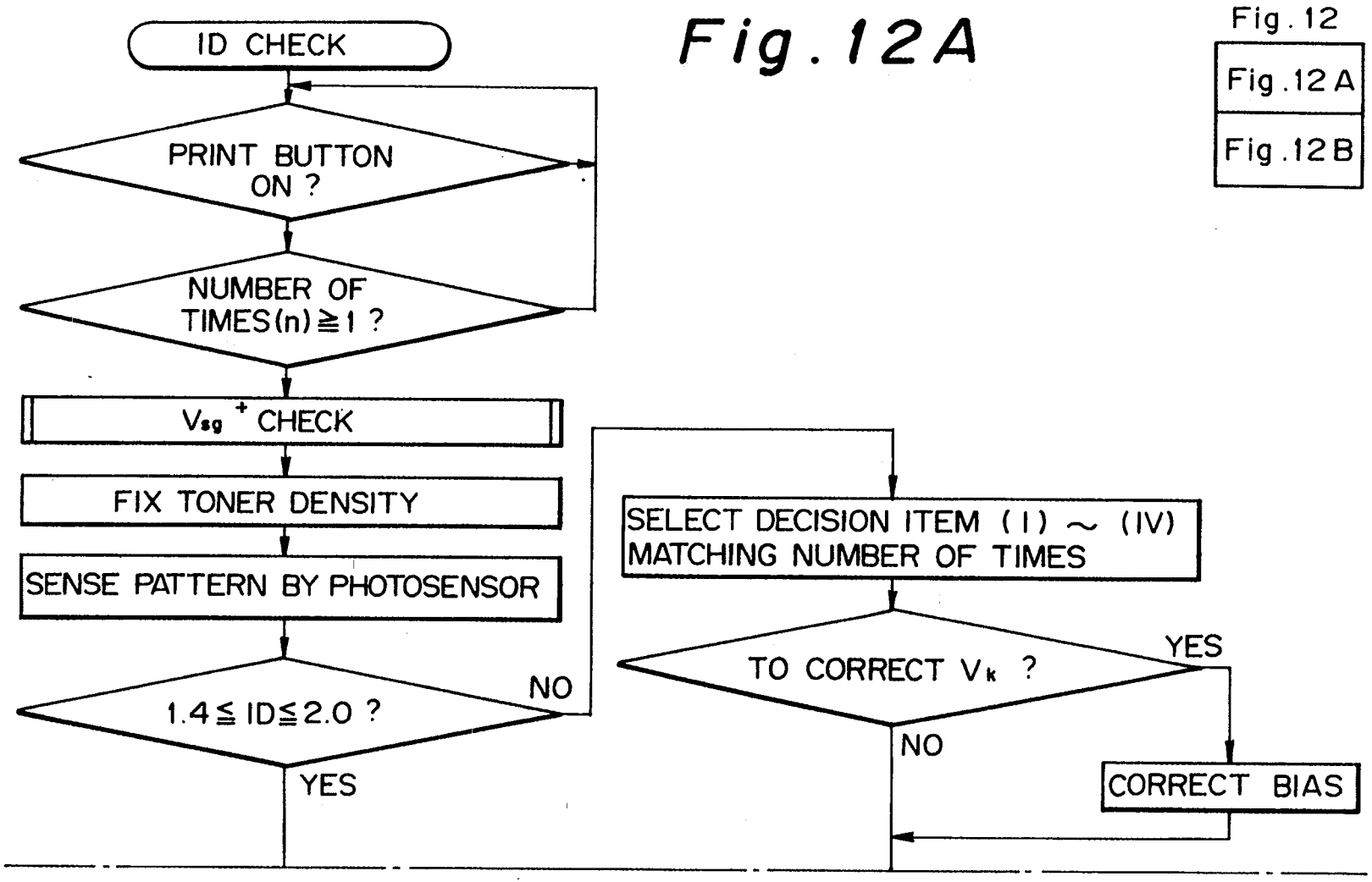
Figure 12B:
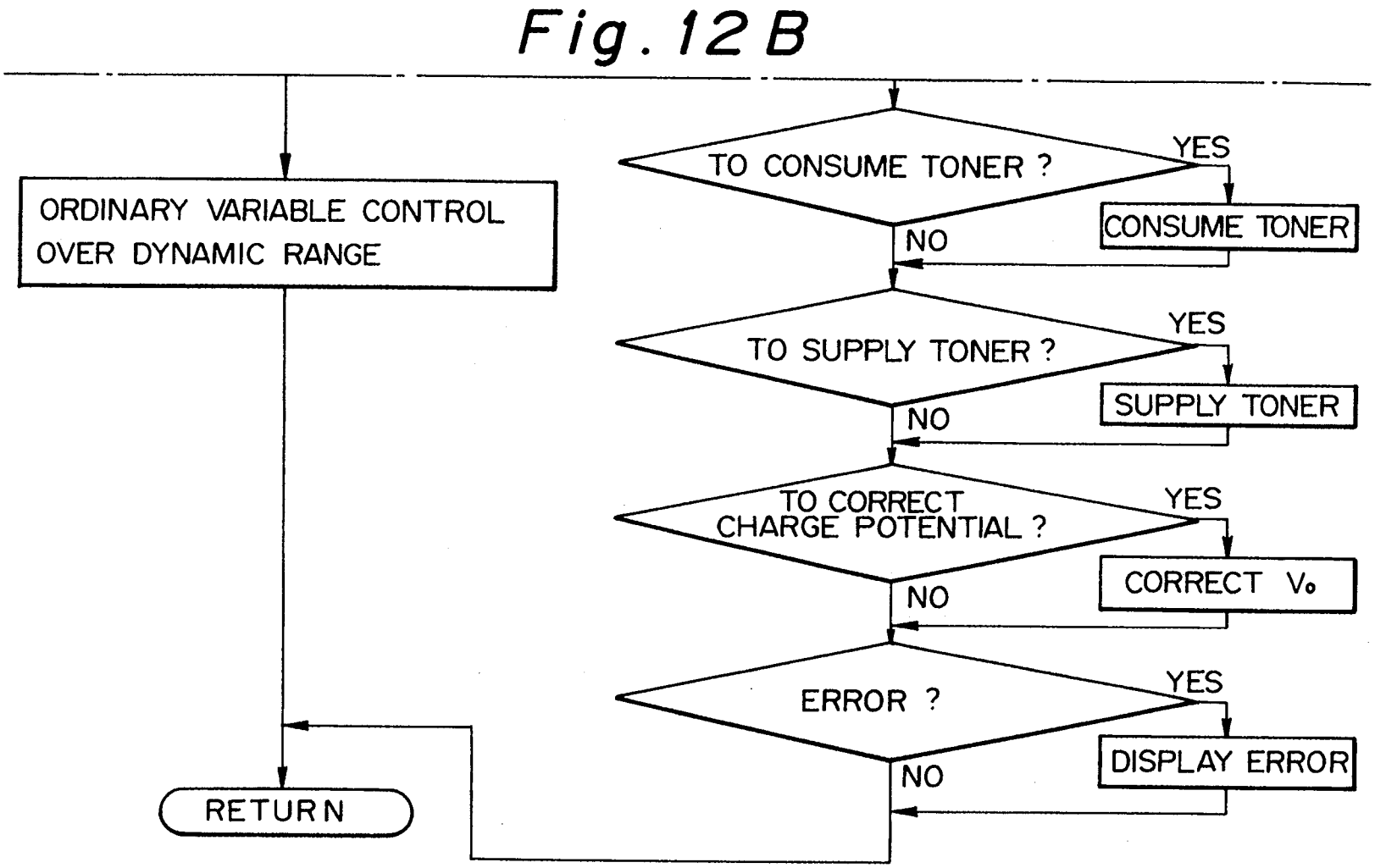

In conditions other than the start-up of the copier, ID check processing shown in FIG. 12 is executed. In the ID check processing, the controller 100 detects the background potential Vsg+ and then fixes the toner density. Thereupon, the controller 100 determines whether or not the copy button has been pressed and, if the answer is positive, determines how many times it has been pressed by use of a counter, for example. Subsequently, the controller 100 senses a pattern with the photosensor and then determines whether or not the density represented by the output of the photosensor lies in a predetermined range with respect to the standard density ID. Based on the number of copying operations having been performed and the sensed density, the controller 100 executes the Vk correction for correcting the bias relating to the sequence of items (a)–(f), selection control as to the supply or the consumption of toner, and the decision relating to the correction of the charge potential on the drum. If the sensed density lies in the above-mentioned range, the controller 100 variably controls the dynamic range concerning the bias for image formation, charge potential, or the amount of exposure. By the above processing, whether or not the parameters are adequate is determined after the toner density has been fixed regarding the dynamic range every time the image forming operation is performed. When density setting is to undergo transition to the outside of the adequate range, the conditions for processing relating to the dynamic range or those for processing relating to the toner supply/consumption are selected and optimized. This prevents the density from being sharply changed.

Figures 1, 2, 13A:
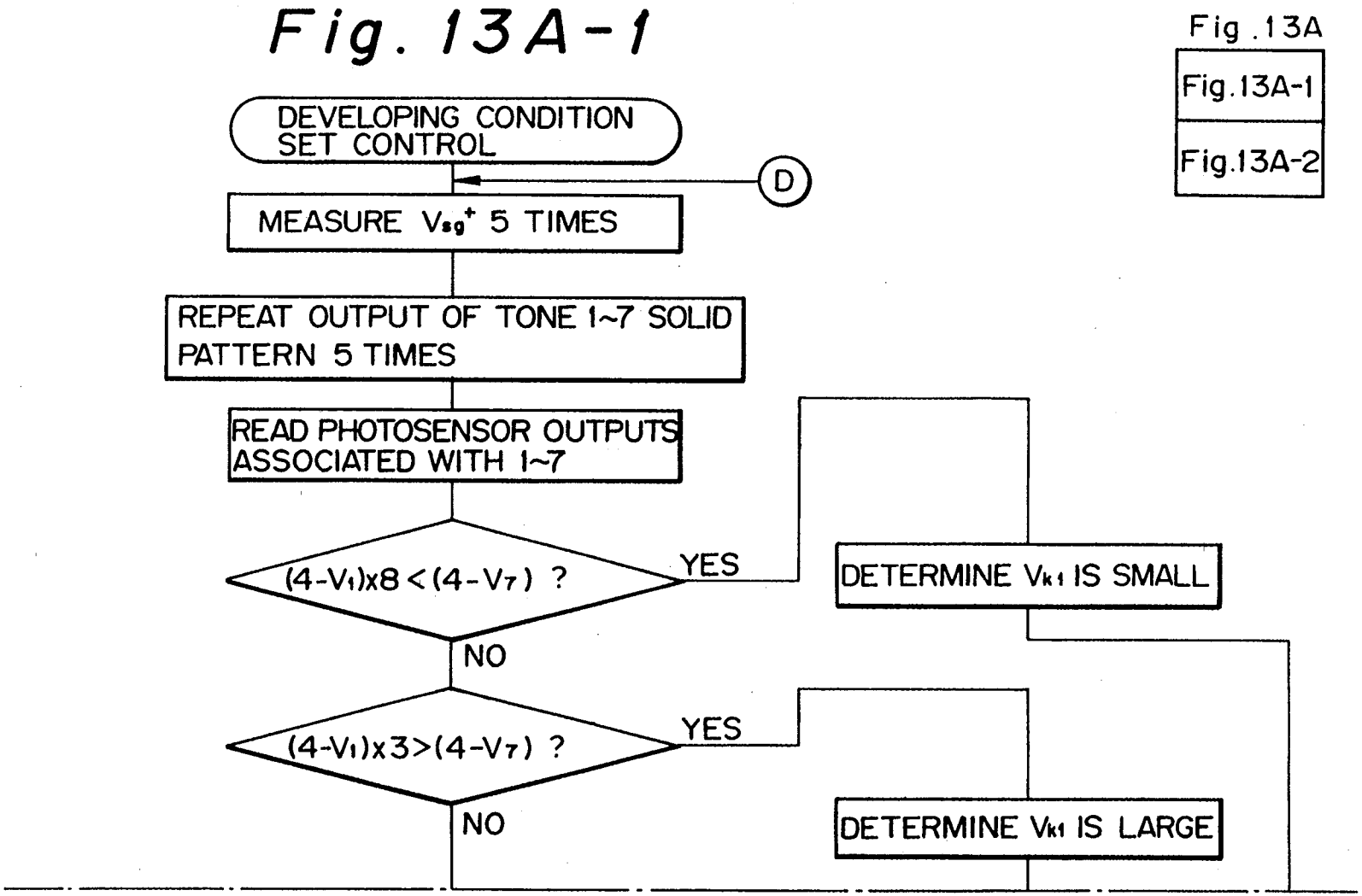
Figures 2, 13A:
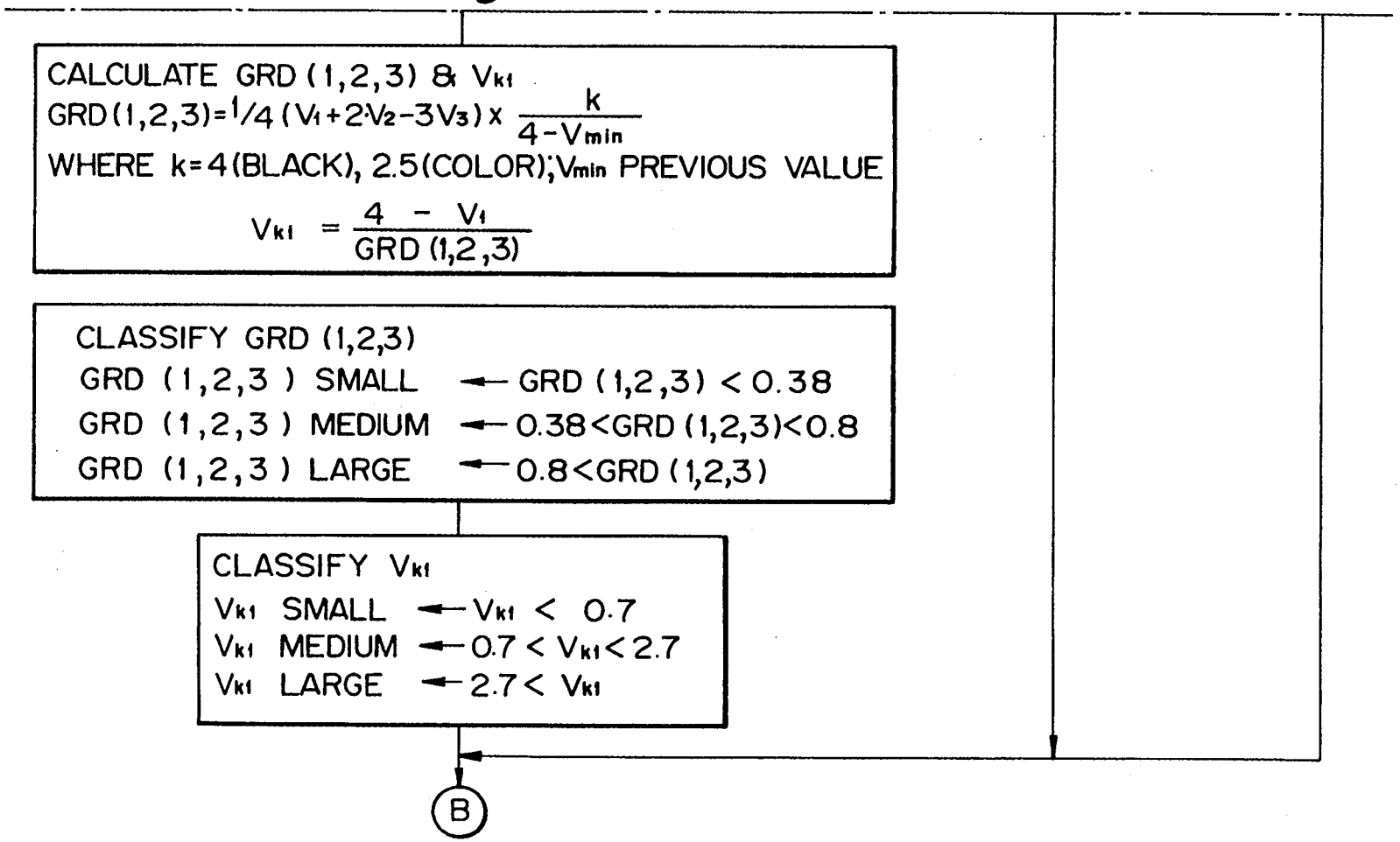
Figure 13B:
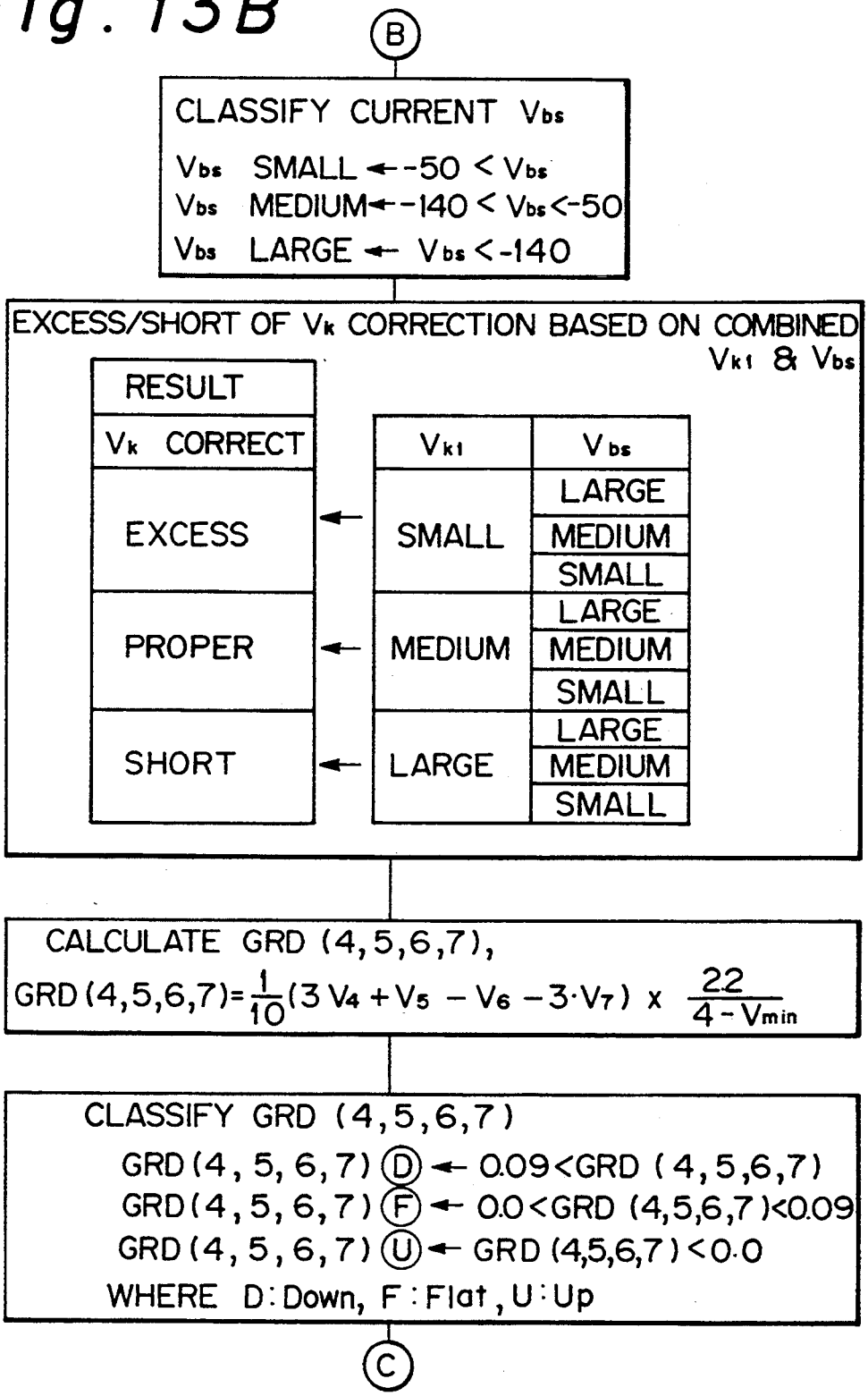
Figure 13C:
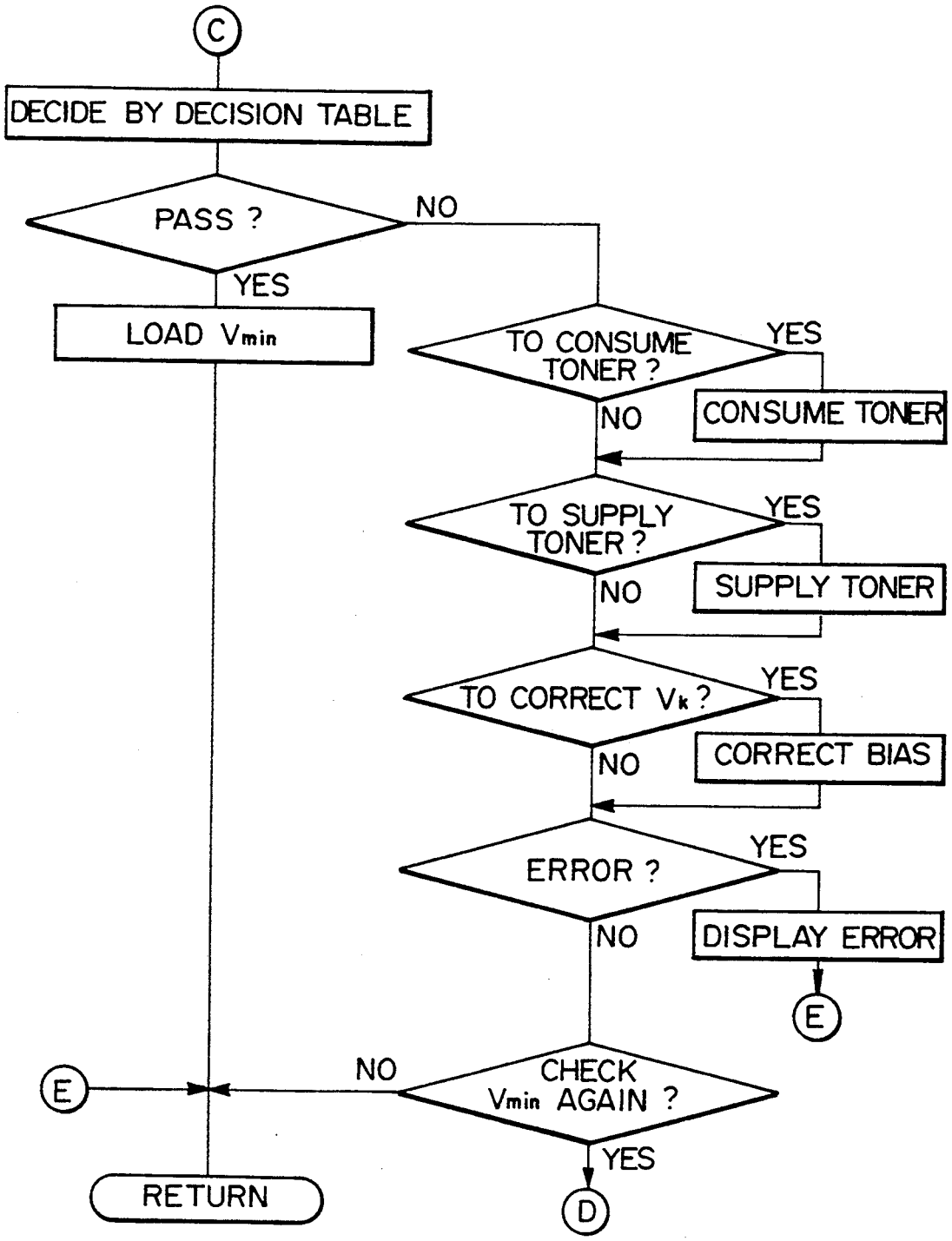

Further, the illustrative embodiment can determine the current conditions of toner deposition, e.g., whether or not the control over the shift of the bias and the toner supply is adequate by self-checking on the basis of the change in the sensor output. For this decision, the controller 100 determines the gradient $\theta$, FIG. 10, of the sensed values in tones 1–3, the shift of the bias, and the sensed values in tones 4–7, i.e., the minimum gradient $\phi$. Then, the control section 100 determines whether the gradient lies in the predetermined range with respect to the gradient of the sensor output associated with the target reference pattern density, and determines the current condition (excessive, adequate or short) of the shift of the bias which sets up such a gradient. In the above processing, as shown in FIGS. 13A through 13C, while the drum is rotated and the developing sleeve is held in a halt, the mean value Vsg+ of the surface potentials or background potentials Vsg of the drum is determined, and then the potentials associated with the densities of solid images matching tones 1–7 are read. When, among such data, the first data is neither great nor small as to the amount of correction, the gradient of the potentials is determined. This gradient is the gradient of potentials associated with the highlight portion in tones 1–3. After the decision as to the resulted gradient, the minimum value of the sensed values is produced by the equations (15)–(24) as well as the amount of correction Vk of the bias. These values are used to examine the amount of correction of the bias. Then, the current condition of the shift of the bias is determined to see if the amount of correction is excessive or short. On the other hand, the gradient of sensed potentials associated with solid patterns corresponding to tones 4–7 is calculated and then determined as to "up", "flat" and "down". Thereafter, the controller 100 determines the current condition of the minimum value, i.e., whether or not the correction of toner density is necessary on the basis of the results of the above decisions and according to the list shown in FIGS. 6A and 6B.

In this embodiment when the amount of toner is excessive, it is consumed on the drum by a method, not shown, before an image form command appears while, at the same time, the bias for development is corrected. When the toner is short, a drive signal is fed to the toner supply portion to supply the toner while, at the same time, the bias for development is corrected. Thereafter, the minimum value Vmin is calculated again and stored in the RM 100B to prepare for the next image forming operation.

As stated above, when the minimum value of the density sensed from the current reference pattern is changed from the value corresponding to the target reference pattern density, the condition of the minimum value is determined. Hence, even when the minimum value is not stable, the toner control for forming an image can be executed. Especially, when the toner density on the drum, i.e., the amount of toner deposition cannot be corrected by the control over the bias alone, the toner control is continued until the gamma for development which is the potential between the developing potential (difference between the surface potential of the drum and the developing electrode potential) has been achieved. This allows the toner to be supplied and thereby corrects the toner density on the drum adequately via the reference pattern density.

Assume that when the minimum value of the density sensed from the current reference pattern is changed relative to the sensed value corresponding to the target reference pattern density, the decision as to the condition of the minimum value cannot stabilize it. In this case, the embodiment not only controls the toner supply and corrects the bias but also variably controls the dynamic range relating to the formation of an image. This will be described with reference to FIG. 14 and successive figures.

Figure 14A:
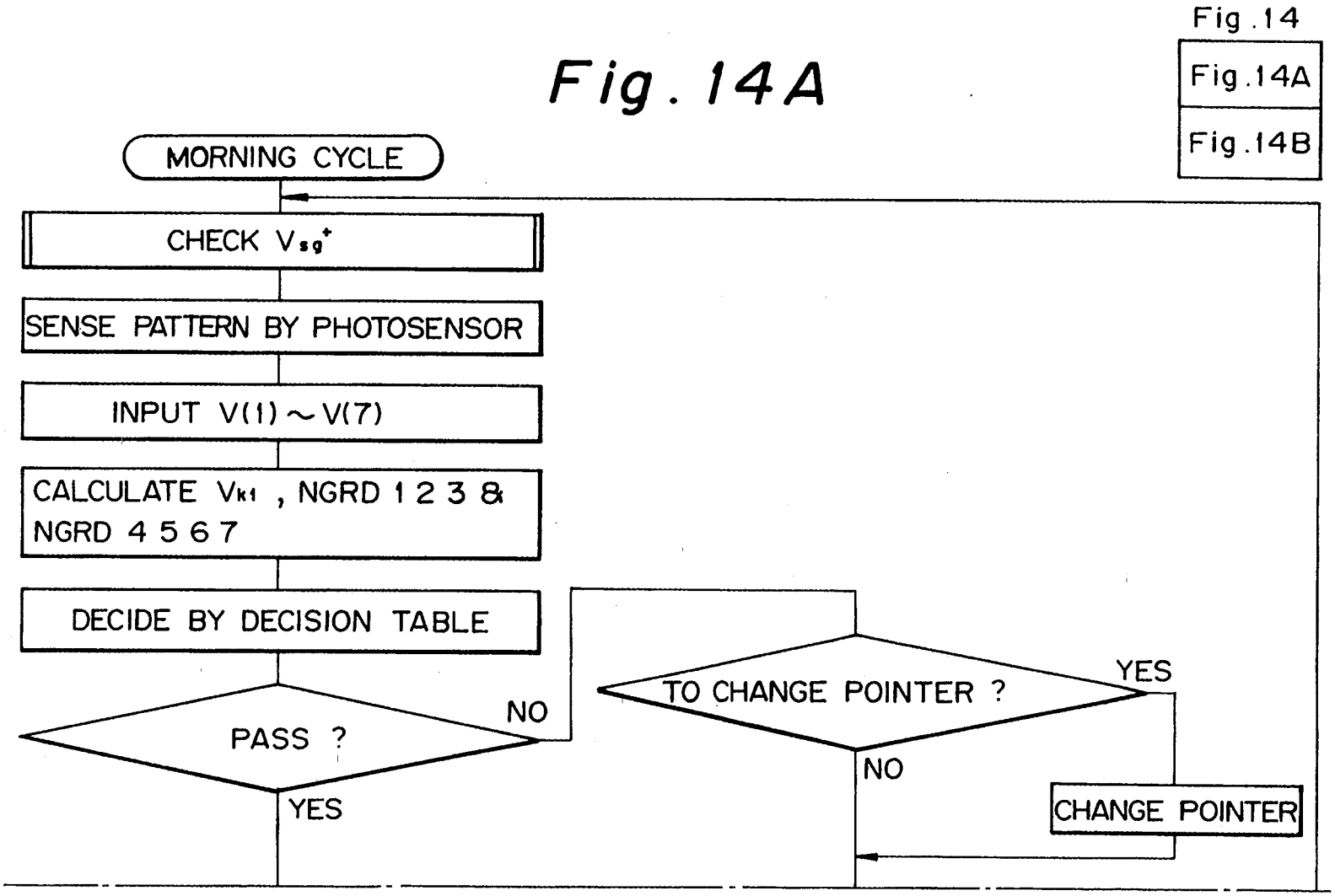
Figure 14B:
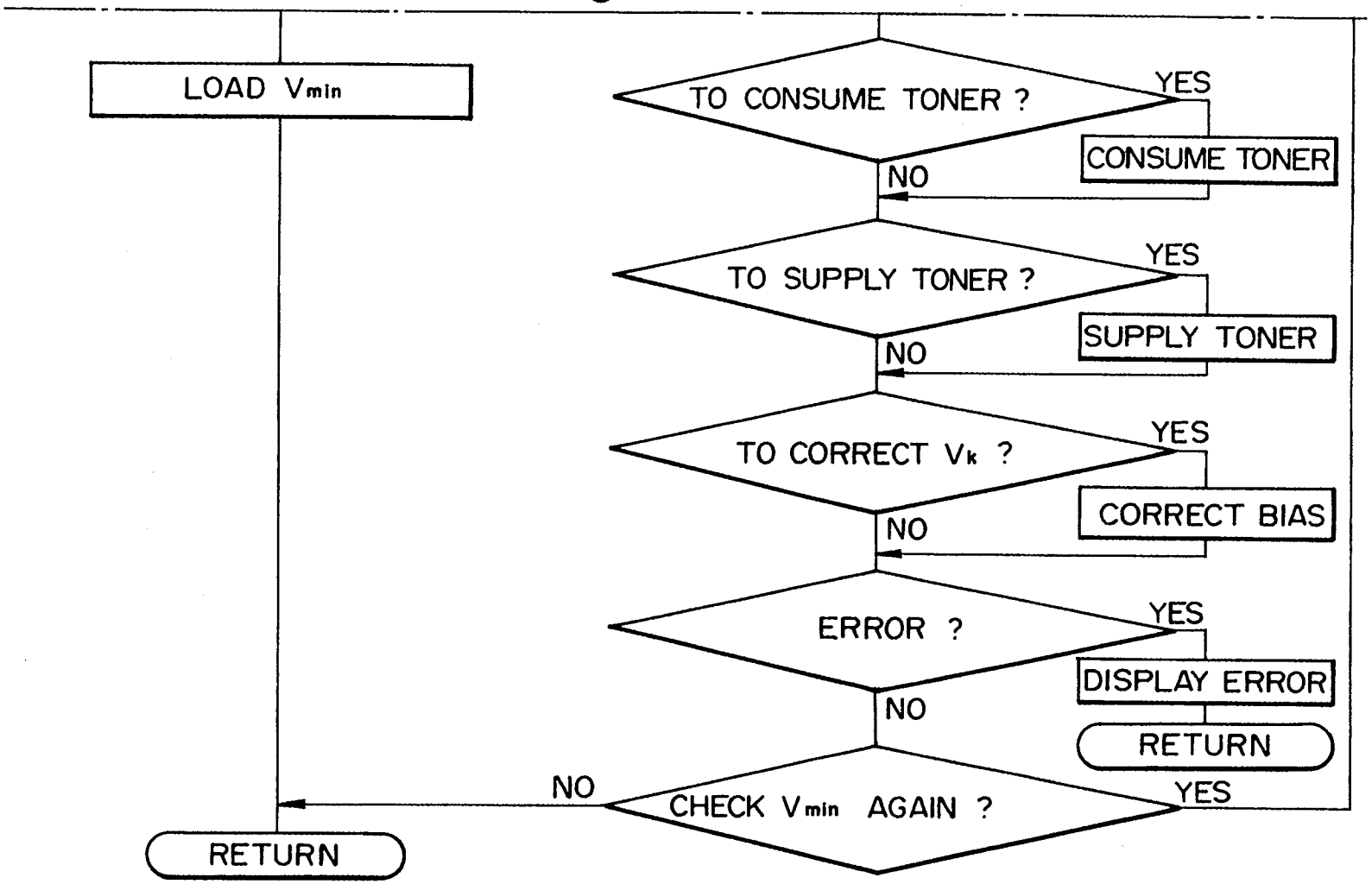

Specifically, to effect the variable control over the dynamic range, a morning cycle shown in FIG. 14 is executed for producing the minimum value of the sensed potentials by the equations (15)–(24). At the same time, the amount of correction Vk of the bias is determined. Then, a reference is made to a decision table shown in FIGS. 15A and 15B to determine the current condition of the minimum value, i.e., whether or not the toner density needs correction and whether or not a pointer should be changed. If the amount of toner is excessive, it is consumed on the drum by a method, not shown, before an image form command appears. If the amount of toner is short, the toner is supplied and the bias corrected. The change of the point will be described with reference to a flowchart later. Thereafter, the minimum value Vmin of the sensor output is calculated again and stored in the RAM 100B to prepare for the next image forming operation. FIGS.

15A and 15B correspond to each other as to the columns describing the result of decision and processing. In this manner, even when the minimum value cannot be stabilized despite the decision as to the condition thereof, the toner control for the formation of an image can be executed to correct the toner density on the drum accurately via the reference pattern density.

The variable control over the dynamic range for forming an image is executed on the basis of the result of the above decision. In this embodiment, the variable control consists of DIF control and Vbs control.

The DIF control sets up conditions for forming a latent image beforehand and then determines the developing characteristic derived from only the developing potential. A solid image pattern of medium density (photosensor output Vsp), a line pattern of halftone density (photosensor output Vll), and a line image pattern of maximum density (photosensor output Vlh) are formed in the background of the drum. Regarding the image forming conditions, as shown in Table 1 below, any combination of charge potential Vo, bias Vb and Potential Vl which is adapted to set an amount of exposure, a pointer P indicative of the position of such a combination on the memory are used together with:

Vdo: Vll-Vlh target value
p1: lower limit of pointer
P2: upper limit of pointer
P0: constant greater than P1 and smaller than P2
Di(=0, 1, 2): increase/decrease of pointer (Do≦D1≦D2)
Vdn: constant determining unvariable range of pointer
Vda: running average of differences between Vll and Vlh The control is executed as shown in Table 2 also shown below.

TABLE 1

| POINTER P | $V_o$ | $V_b$ | $V_c$ | $V_o$-$V_b$ |
|---|---|---|---|---|
| 0 | 353 | 278 | 188 | 75 |
| 1 | 369 | 290 | 196 | 78 |
| 2 | 384 | 306 | 208 | 78 |
| 3 | 400 | 318 | 216 | 82 |
| 4 | 416 | 329 | 224 | 86 |
| 5 | 431 | 345 | 235 | 86 |
| 6 | 447 | 357 | 243 | 90 |
| 7 | 463 | 369 | 255 | 94 |
| 8 | 478 | 380 | 263 | 98 |
| 9 | 494 | 396 | 275 | 98 |

TABLE 1-continued

| POINTER P | $V_o$ | $V_b$ | $V_c$ | $V_o$-$V_b$ |
|---|---|---|---|---|
| 10 | 510 | 408 | 282 | 102 |
| 11 | 525 | 420 | 294 | 106 |
| 12 | 541 | 431 | 302 | 110 |
| 13 | 557 | 447 | 314 | 110 |
| 14 | 573 | 459 | 322 | 114 |
| 15 | 588 | 471 | 329 | 118 |
| 16 | 604 | 486 | 341 | 118 |
| 17 | 620 | 498 | 349 | 122 |
| 18 | 635 | 510 | 361 | 125 |
| 19 | 651 | 522 | 369 | 129 |
| 20 | 667 | 537 | 380 | 129 |
| 21 | 682 | 549 | 388 | 133 |
| 22 | 698 | 561 | 396 | 137 |
| 23 | 714 | 576 | 408 | 137 |
| 24 | 729 | 588 | 416 | 141 |
| 25 | 745 | 600 | 427 | 145 |
| 26 | 761 | 612 | 435 | 149 |
| 27 | 776 | 627 | 447 | 149 |
| 28 | 792 | 639 | 455 | 153 |
| 29 | 808 | 651 | 463 | 157 |
| 30 | 824 | 667 | 475 | 157 |
| 31 | 839 | 678 | 482 | 161 |

TABLE 2

| POINTER P ASSIGNED TO CONDITIONS ON MEMORY | POINTER P OF CONDITION TABLE (NEXT CONDITIONS) | | | |
|---|---|---|---|---|
| DEC ← DYNAMIC RANGE → INC | | | | |
| $P = P_2$ | DECREASE ONLY D2 | DECREASE ONLY D0 | NO CHANGE | NO CHANGE |
| $P_0 < P < P_1$ | DECREASE ONLY D2 | DECREASE ONLY D0 | NO CHANGE | INCREASE ONLY D1 |
| $P = P_0$ | DECREASE ONLY D1 | NO CHANGE | NO CHANGE | INCREASE ONLY D1 |
| $P_1 < P < P_0$ | DECREASE ONLY D1 | NO CHANGE | INCREASE ONLY D0 | INCREASE ONLY D2 |
| $P = P_1$ | NO CHANGE | NO CHANGE | INCREASE ONLY D0 | INCREASE ONLY D2 |
| ESTIMATION OF CURRENT SIZE TO ADEQUATE DYNAMIC RANGE BASED ON Vda | EXCESSIVE | ADEQUATE OR SOMEWHAT EXCESSIVE | ADEQUATE OR SOMEWHAT SHORT | SHORT |
| (Vll − Vlh) RUNNING AVERAGE Vda (MEASURED) | Vda < Vdo − Vdn | Vdo − Vdn ≦Vda < Vdo | Vdo ≦ Vda <Vdo + Vdn | Vdo + Vdn ≦Vda |

For details of the DIF control, reference may be made to Japanese Patent Laid-Open Publication No. 238107/1989.

The Vbs control is effected to control the shift of the bias so as to maintain the toner density constant, as described previously in relation to the first embodiment.

For example, when the shift Vbs of the bias is smaller than a predetermined value (−100 volts), the Vbs control is selected while, when the former is greater than the latter, the DIF control is selected.

Figure 17A:
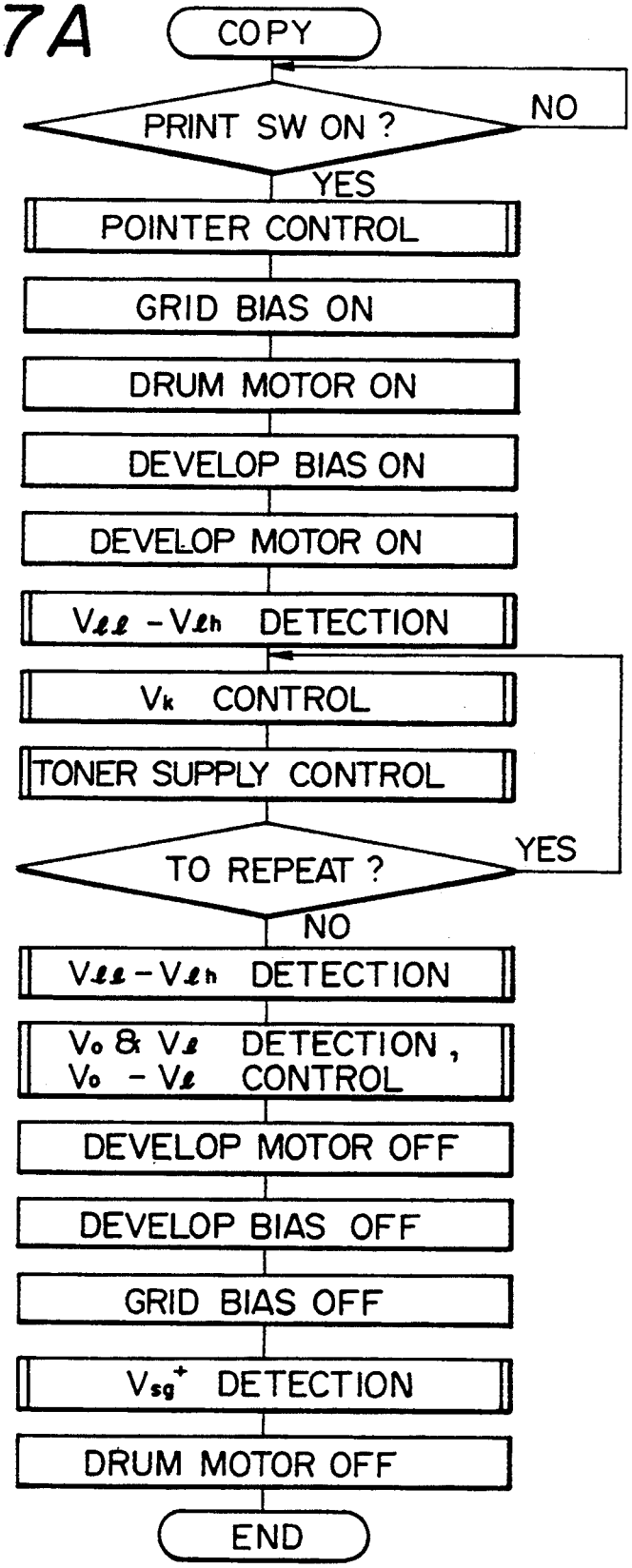
FIGS. 17A through 17H are flowcharts showing other specific operations of the control section.
Figure 17B:
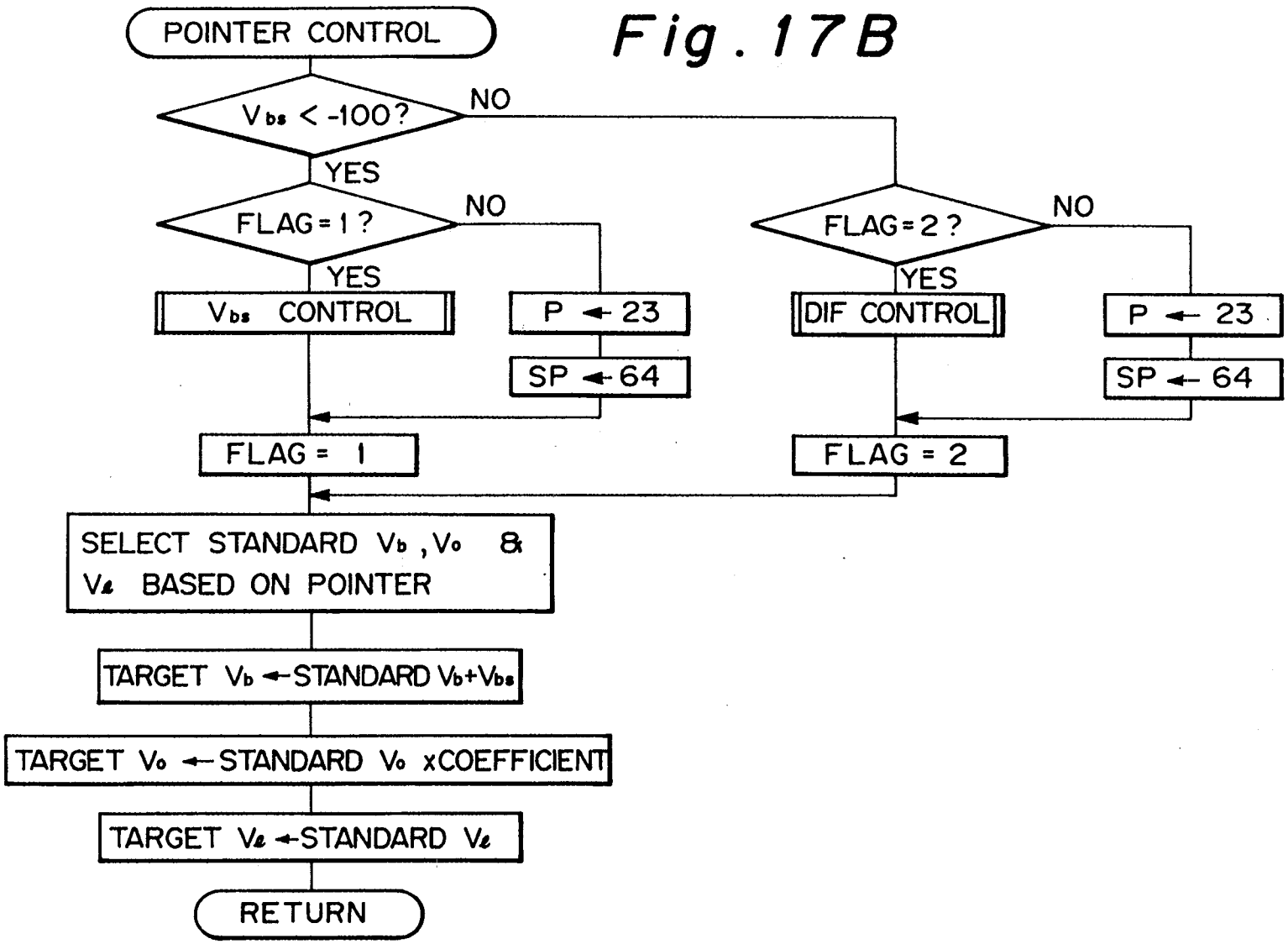

The processing described above is executed at the start-up of the copier, just after the replacement of the drum or just after the supply of a developer according to the flowchart shown in FIG. 14. As shown, whether or not the current condition of the minimum value, i.e., the correction of toner density is adequate is determined on the basis of the decision table. On the turn-on of the print switch, the control section 100 variably controls the charge potential, the bias for development and the amount of exposure for forming an image in response to the result of the above decision, as shown in FIGS. 17A through 17H. Specifically, as shown in FIG. 17A, the control section 100 determines whether or not a print switch has been turned-on and, if has been turned on, senses the background potential. This is followed by a sequence for setting a dynamic range based on pointer control. As shown in FIG. 17B, in the pointer control, the controller 100 determines whether or not the shift Vbs of the bias is smaller than a predetermined value (−100 volts) and, the answer is positive, determines whether or not a flag indicative of such a status is set. Then, the program is transferred to the Vbs control. If the flag is not set, the controller 100 fixes a pointer from a pointer DIF shown in FIG. 3 below to the twenty-third pointer and fixes a subpointer from a pointer-Vbs table shown in Table 4 to the sixty-fourth subpointer.

TABLE 3

| | BELOW DIF0 − α | DIF0 − α DIF0 | DIF DIF0 + α | ABOVE DIF |
|---|---|---|---|---|
| 0 | 0 | 0 | 1 | 4 |
| 1 | | | | |
| . | | | | |
| . | −4 | −1 | 1 | 4 |
| . | | | | |
| 22 | | | | |
| 23 | −4 | −1 | 0 | 0 |

where α is 0.32 volt for development in black or 0.16 volt for development in color.

TABLE 4

| $V_{bs}$ | −104 (23) | −112 (24) | −120 (25) | −128 (26) | −136 (27) | −140 (28) | −152 (29) | −160 (30) | −168 (31) |
|---|---|---|---|---|---|---|---|---|---|
| 23 | 0 | +4 | +16 | +32 | +64 | +128 | +128 | +128 | +128 |
| 24 | −4 | 0 | +4 | +16 | +32 | +64 | +128 | +128 | +128 |
| 25 | −16 | −4 | 0 | +4 | +16 | +32 | +64 | +128 | +128 |
| 26 | −32 | −16 | −4 | 0 | −4 | +16 | +32 | +64 | +128 |
| 27 | −64 | −32 | −16 | −4 | 0 | +4 | +16 | +32 | +64 |
| 28 | −128 | −64 | −32 | −16 | −4 | 0 | +4 | +16 | +32 |
| 29 | −128 | −128 | −64 | −32 | −16 | −4 | 0 | +4 | +16 |
| 30 | −128 | −128 | −128 | −64 | −32 | −16 | −4 | 0 | +4 |
| 31 | −128 | −128 | −128 | −128 | −64 | −32 | −16 | −4 | 0 |

Figure 17C:
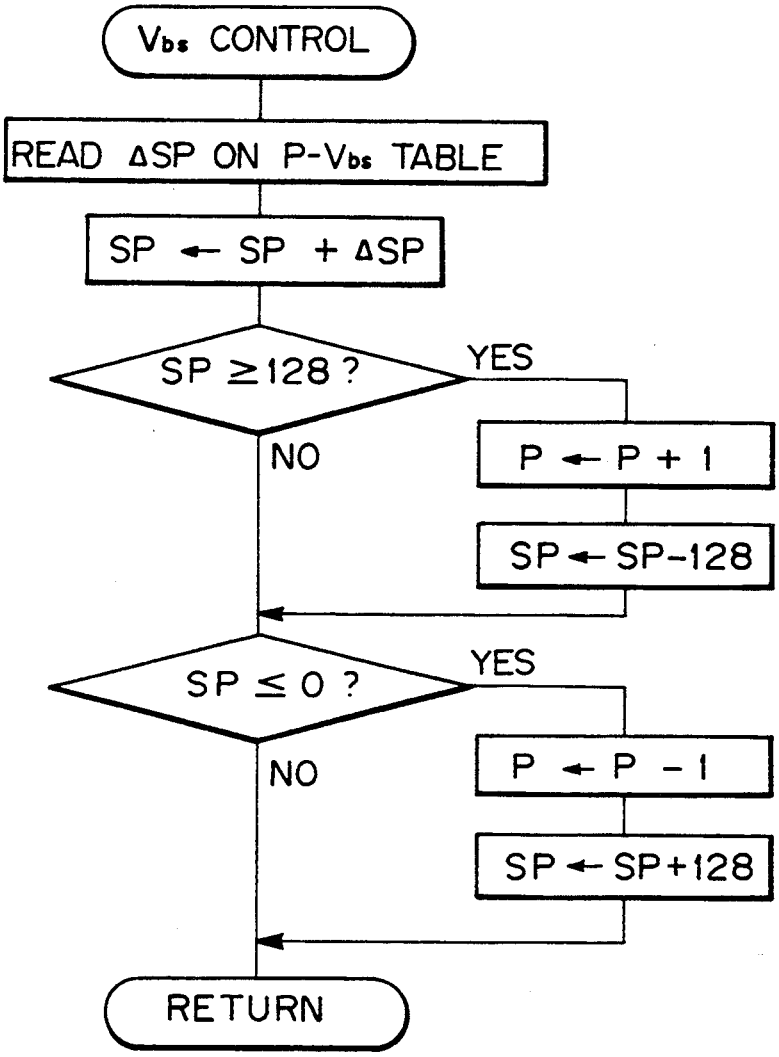

As shown in FIG. 17C, in the Vbs control, the control section 100 selects ΔSP from pointer Vbs table and, if the subpointer is greater than "128", raises the pointer one step and adds a o predetermined value to the subpointer. If the subpointer smaller than zero, the control section 100 lowers the pointer one step and subtracts a predetermined value from the subpointer. If the shift Vbs of the bias is not smaller than the predetermined value, the control section 100 sees if a flag indicative of this status is set and, if it is set, executes the DIF control. If such a flag is not set, the control section fixes the pointer and subpointer as in the Vbs control.

Figure 17D:
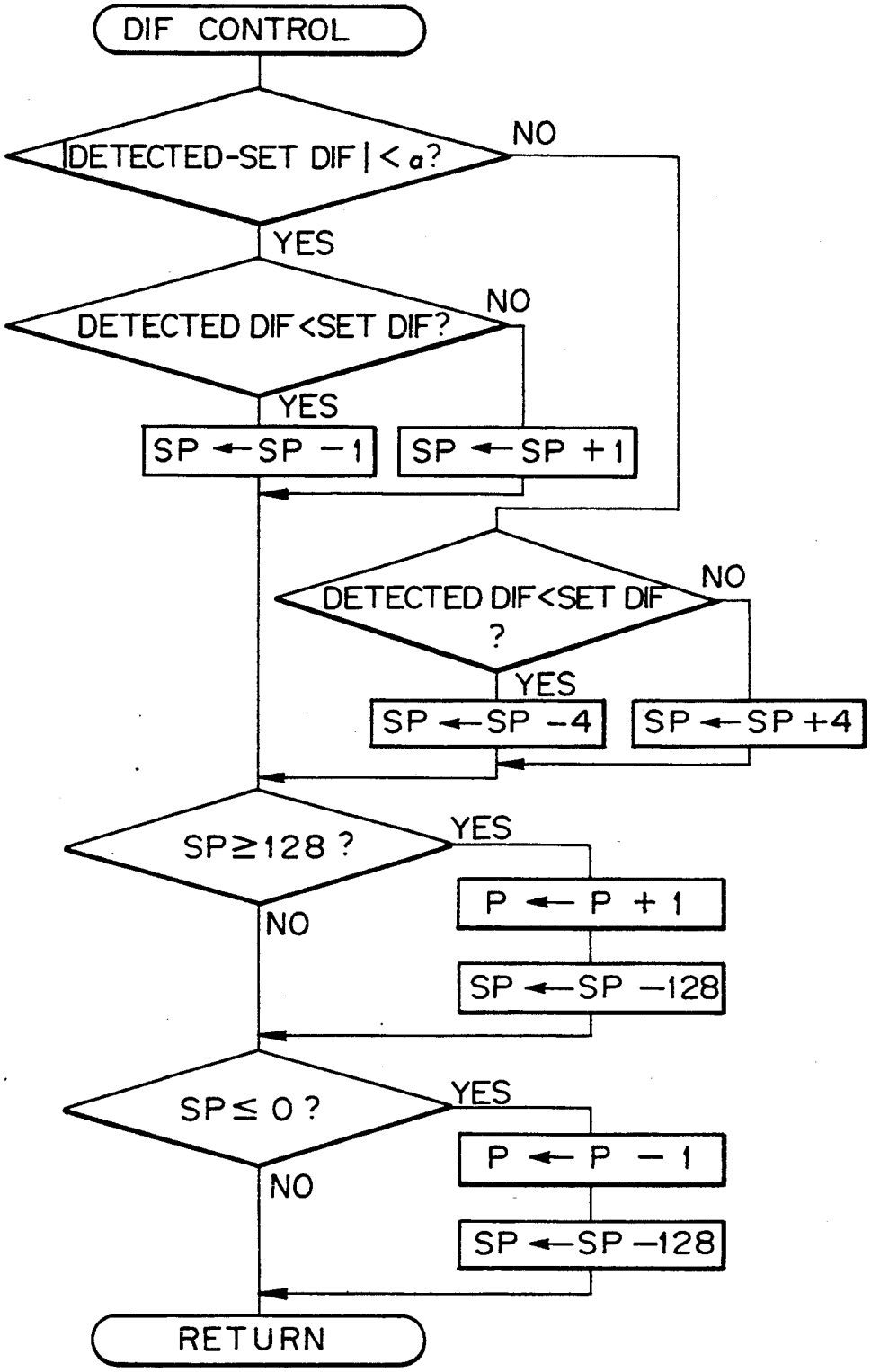
Figure 17E:
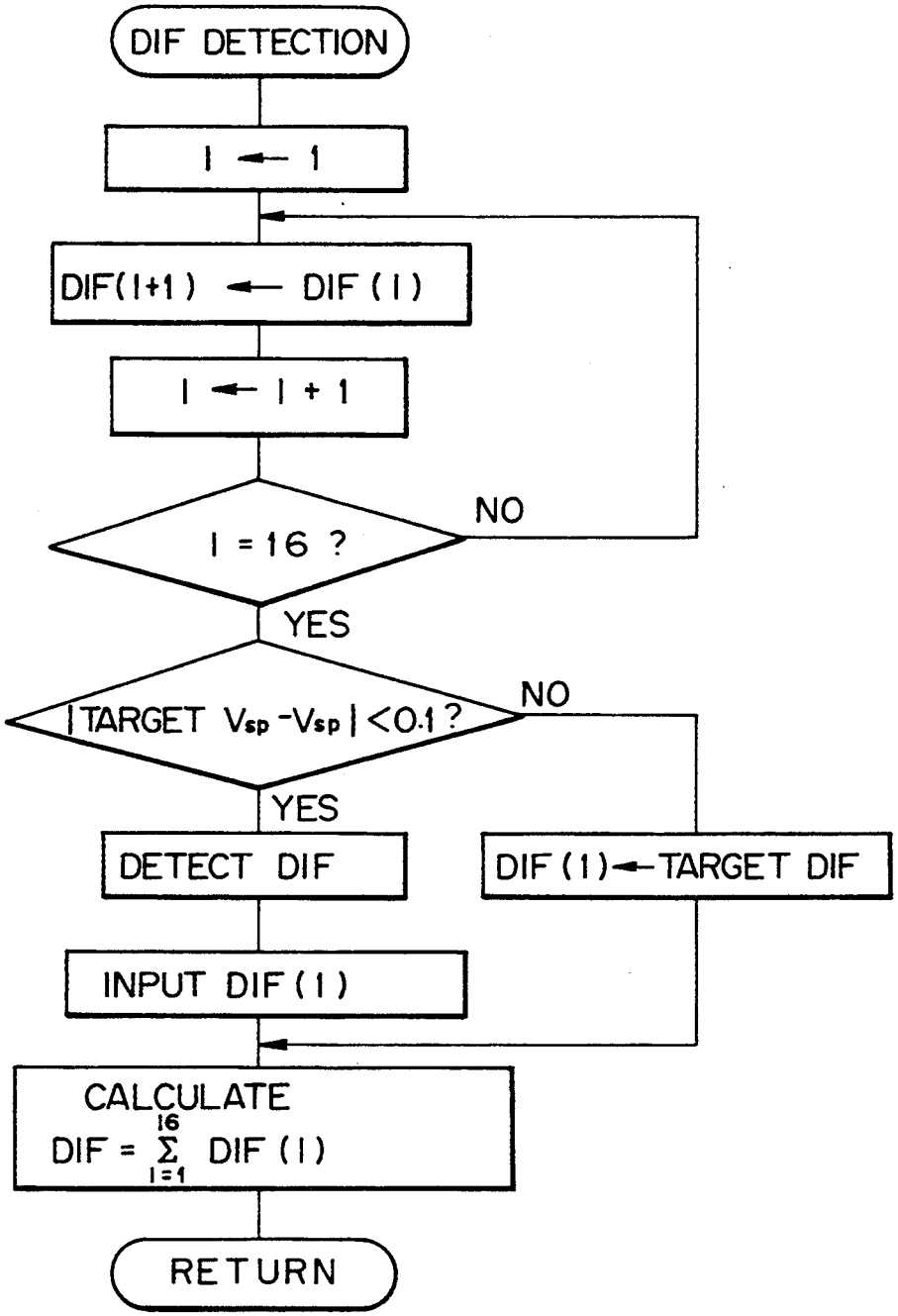

As shown in FIG. 17D, in the DIF control, the controller 100 determines a difference α between the DIF sensed value and a DIF set value produced by the previously stated Vll–Vlh. The controller 110 determines whether or not the difference α is smaller than 0.24 volt in the case of black development or smaller than 0.12 volt in the case of color development. If the result of this decision is positive, the controller 100 determines which of the sensed and set values is greater than the other and then adds or subtracts a predetermined value from the subpointer shown in Table 4. If the decision as to the difference α is negative, the controller 100 determines which of the sensed and set values is greater than the other and then adds or subtracts a predetermined value from the subpointer shown in FIG. 4. Then, depending on whether the subpointer is greater or smaller than "128", the controller 100 adds or subtracts a predetermined value from each of the pointer and subpointer. Then, the controller 100 determines whether or not the subpointer is "0" and, if the answer is positive, subtracts a predetermined value from each of the pointer and subpointer. As shown in FIG. 17E, the controller 100 executes DIF detection included in the DIF control. Specifically, the controller 100 sets initial values associated with tones 0–7, updates the difference Vll–Vlh, and updates the initial values also. Then, the controller 100 determines whether or not the detection in all of the tones has completed and, if it has completed, calculates a difference between the sensed value and the target value and compares them. If the difference between the sensed and target values is smaller than a predetermined value, the controller 100 inputs the data deciding that it has executed the DIF detection. Finally, the controller 100 calculates the sum of the output data in all of the tones and uses the result in setting a pointer in the DIF control.

After setting the shift of the bias or the amount of charge potential correction by the Vbs control or the DIF control, the controller 100 selects a standard bias, a standard charge potential and a standard amount of exposure on the pointer table, as shown in FIG. 17B. Then, the controller 100 corrects them to their effective values. As soon as the bias, charge potential and amount of exposure are selected, the charger and the section for driving the developing sleeve are turned on while the drum is started to be rotated to start forming an image thereon. The photosensor senses the resultant reference pattern formed on the drum. As a result, the correction of the bias, i.e., the Vk control shown in FIG. 23 and described in relation to the third embodiment is executed. Specifically, in the Vk control, the controller 100 calculates the bias Vb by using the equation (1), updates the initial bias, and determines whether or not the updated bias has resulted from a predetermined number of times of consecutive entry of data from the photosensor. Then, the controller 100 determines the density of the reference pattern provided by the above-mentioned bias, and then averages eight outputs of the photosensor to compare the mean value with the target Vk. If the result of comparison is negative, the controller 100 determines whether or not the image formed is the first image and, if the answer is positive, sets a value which is, for example, greater than a small potential difference to be applied during ordinary image formation (20 volts in the embodiment). This is to increase the stepwise change with respect to the set density to thereby reach the set density more rapidly, compared to the prior art. The photosensor senses the reference pattern resulted from such a potential difference. The controller 100 compares the resultant output of the photosensor with the target output and, if the former is greater than the latter, adds the potential difference to the shift. If the output of the photosensor is smaller than the target output, the controller 100 reduces the potential difference to thereby determine a bias, as stated earlier.

Figures 1, 17F:
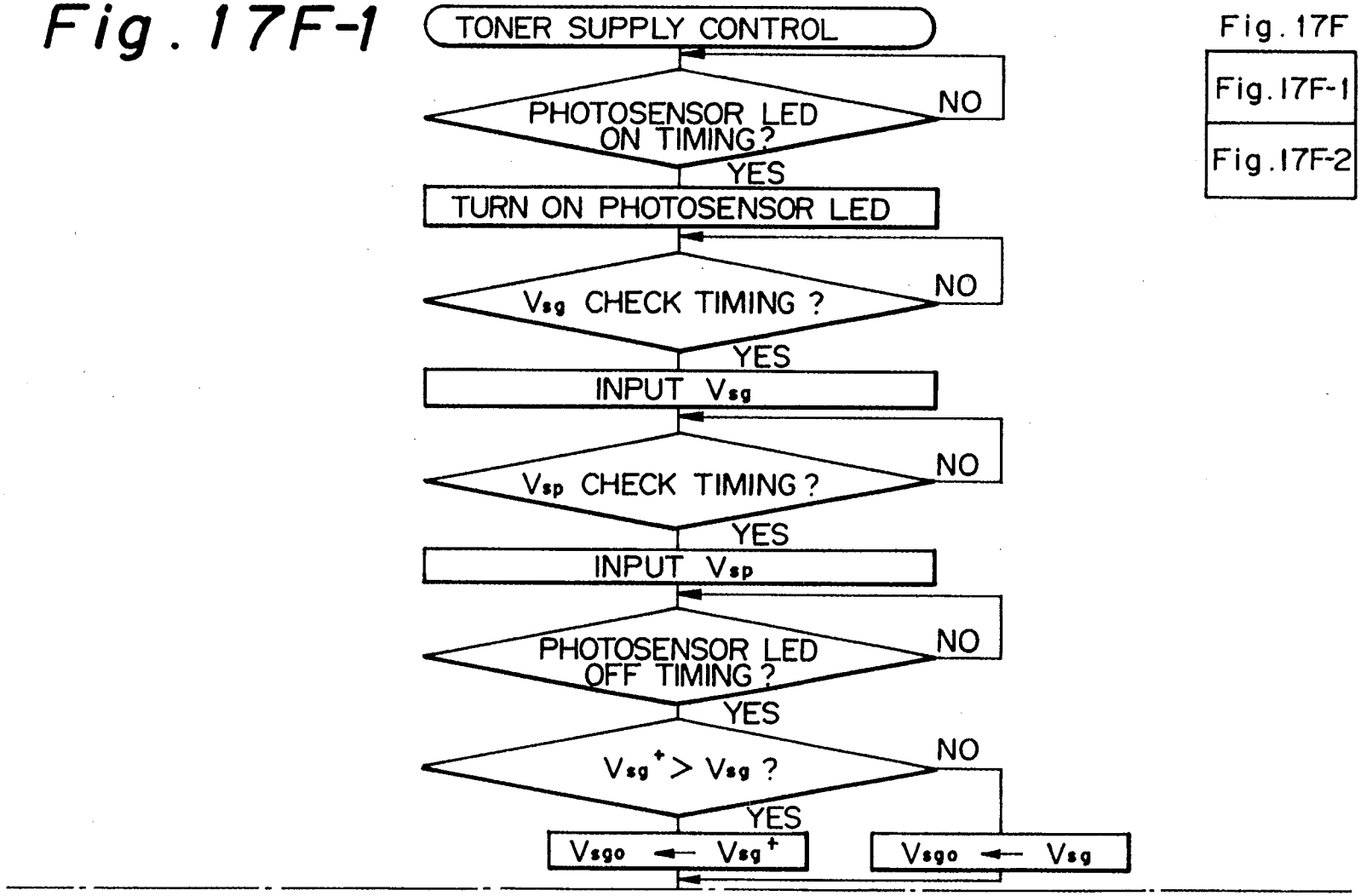
Figures 2, 17F:
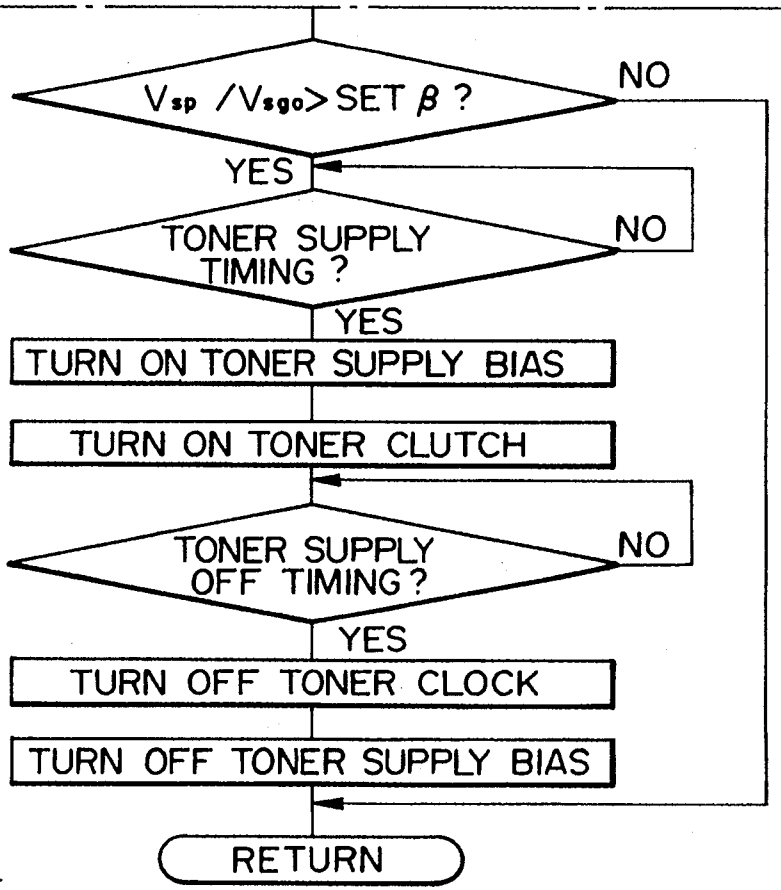
Figure 17G:
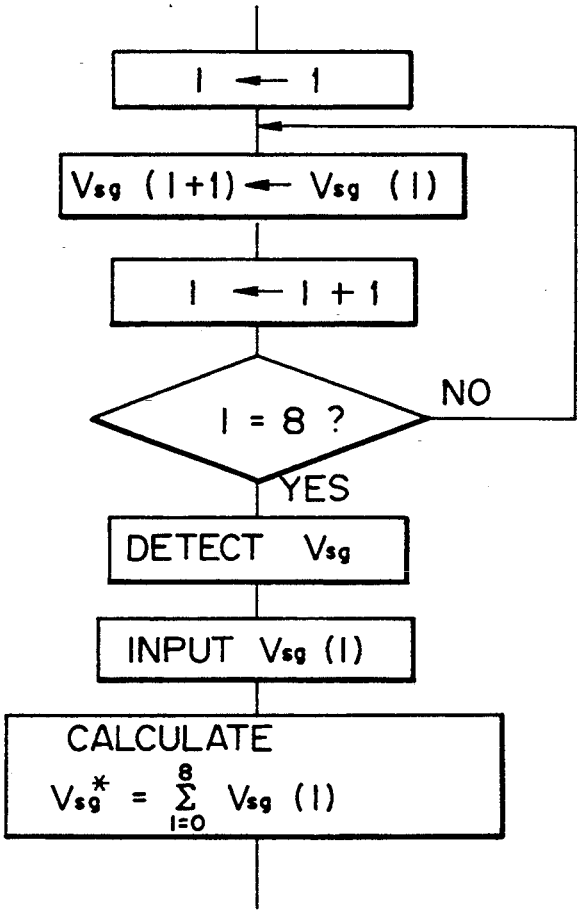
Figures 1, 17H:
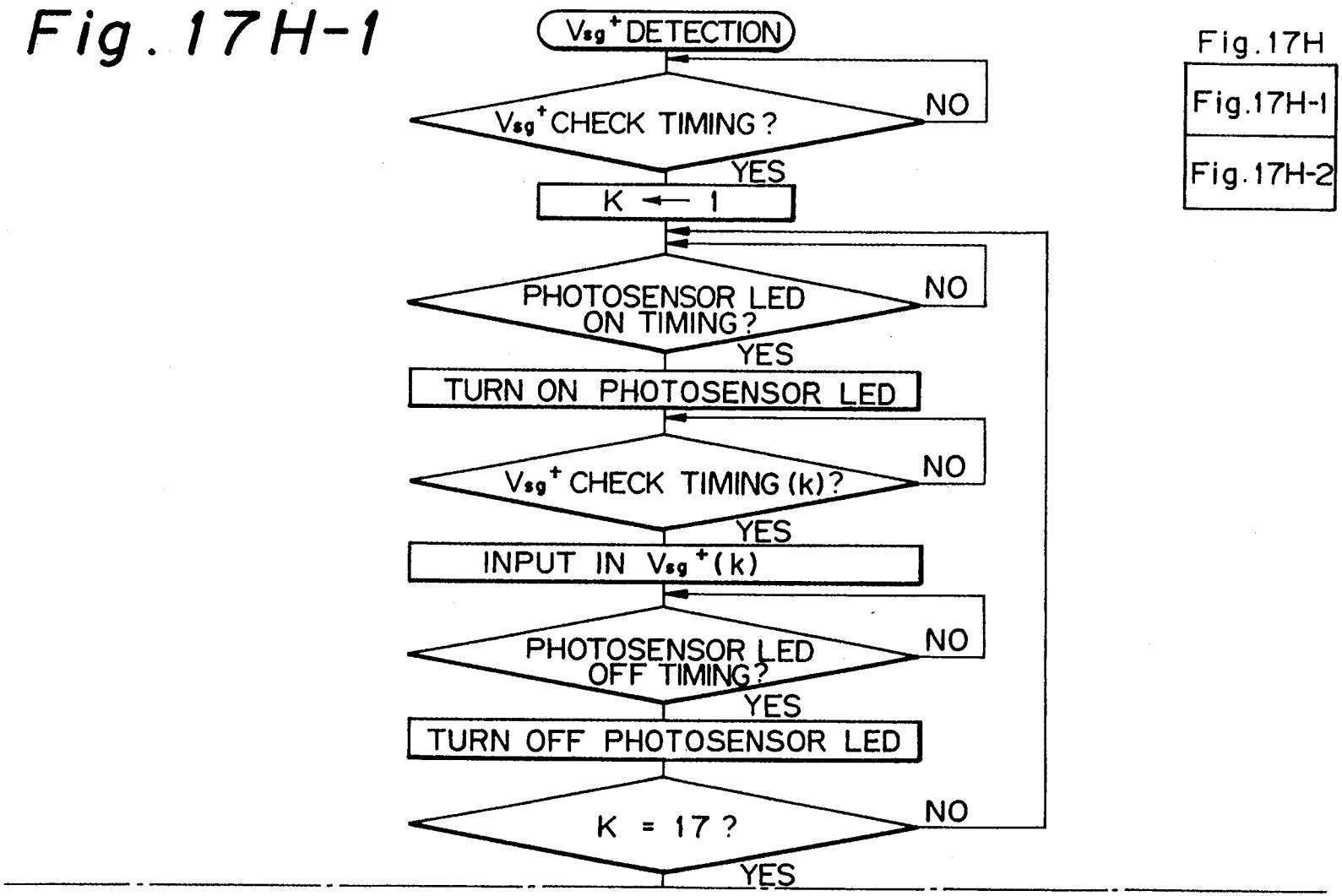
Figures 2, 17H:
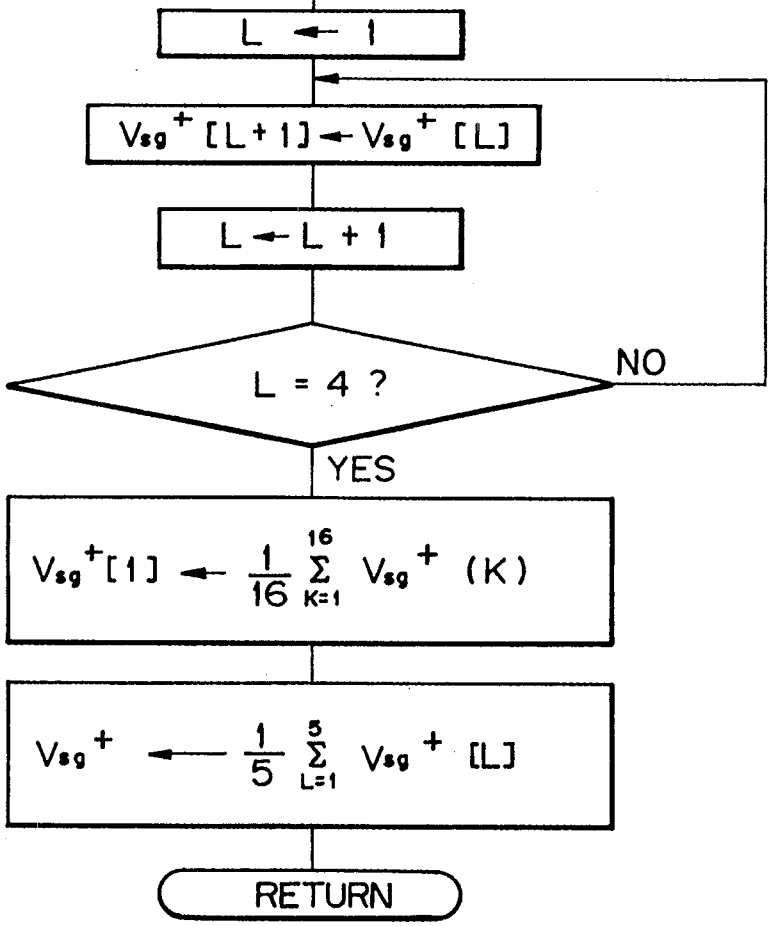

FIG. 17F shows toner supply control to be executed on the basis of the above-described control over the dynamic range. As shown, the background potential of the drum and the density of the reference pattern formed in the background each is detected at a particular timing. The resulted background voltage Vsg is compared with the background voltage Vsg+ which was sensed when the developing sleeve was in a halt. If the voltage Vsg+ is higher than the voltage Vsg, it is determined that the background is free from contamination, and a voltage Vsgo is set. If otherwise, meaning that the background has been contaminated, the current background voltage Vsg is substituted for the voltage Vsgo. Then, whether or not the ratio between this voltage Vsg and the voltage representative of the density of the reference pattern is greater than a predetermined coefficient, i.e., whether or not the toner should be supplied is determined, and processing matching the result of decision is executed. Regarding the processing for inputting Vsg, as shown in FIG. 17G, eight data may be averaged and then compared with the background voltage Vsg+, as in the case of Vk control. After the toner supply control described above, whether or not the copying operation should be repeated is determined. If the result of this decision is negative, the final processing for setting a dynamic range is executed, and the voltage Vsg+ is detected. Specifically, as shown in FIG. 17H, the background voltage is read every time the print button is turned on and off; the turn-on and turn-off of this button is effected the number of times corresponding to tones 0–7. The resulted data are averaged, and the mean value is memorized as a background voltage.

As stated above, the illustrative embodiment grasps the dynamic range of the output voltage of the photosensor accurately by detecting a signal which makes the output of the photosensor minimum without depending on the change in the reflection from the drum. At this instant, the embodiment determines whether or not the change in the minimum value does not match the actual actual amount of toner deposition on the drum and then executes the toner density control using the minimum value. This allows the toner density to be controlled with accuracy without depending on the reflection characteristic of the drum, thereby improving the image quality.

The embodiment stabilizes the density of the toner to be deposited on the drum by the variable control over the dynamic range, the control over the toner supply, and the variable control over the bias for development, as stated above. In addition, the embodiment detects the deterioration of the drum surface due to aging and determines that the change in detected voltage which affects the stabilization of the toner density indicates the time for replacement of the drum, as follows.

Figure 18:
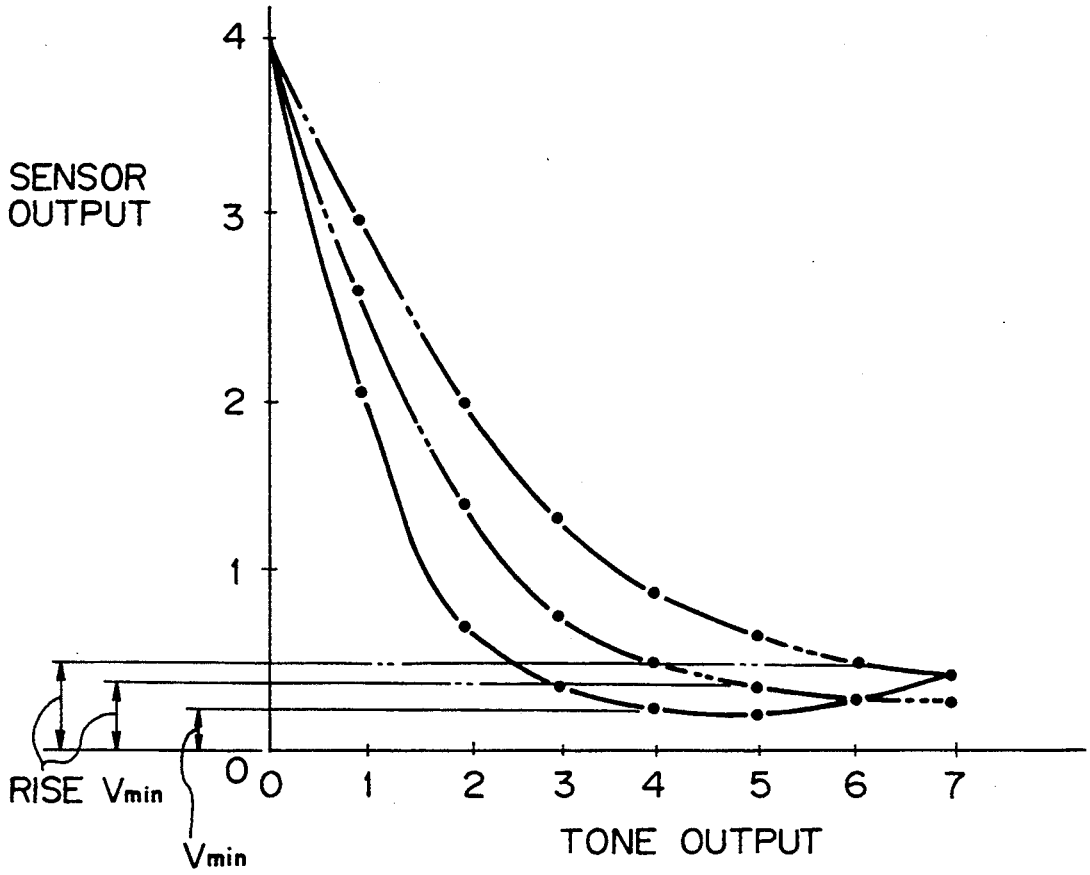
FIG. 18 is a graph showing other specific conditions which the control section uses.
Figure 19:
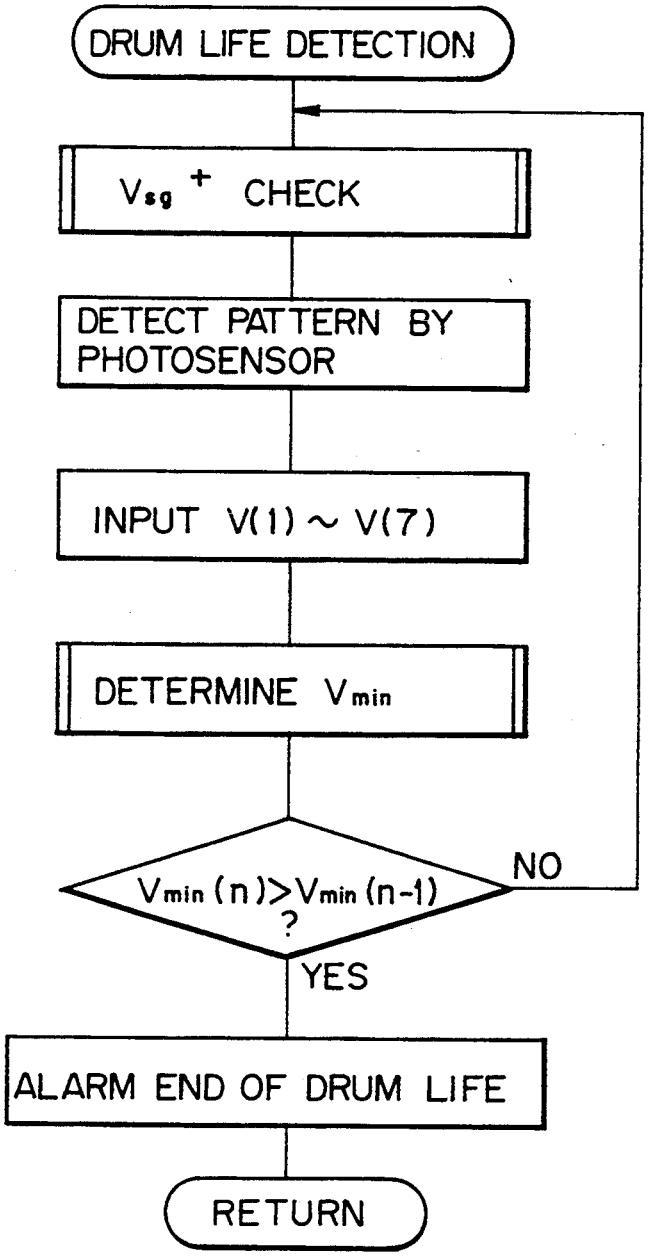
FIG. 19 is a flowchart demonstrating another specific operation of the control section.
Figure 20:
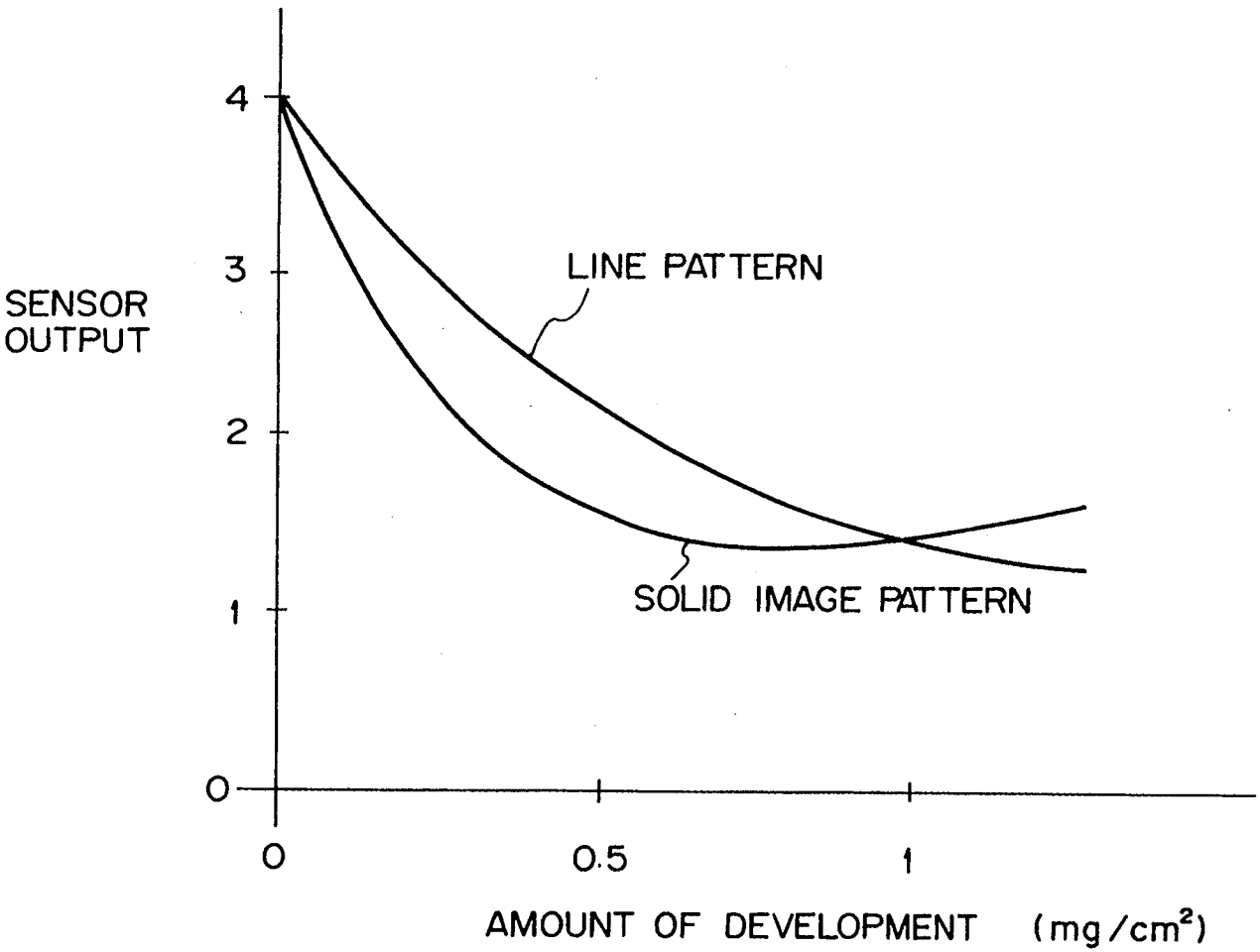
FIG. 20 is a graph indicative of the optical reflection characteristic of a toner.

As shown in FIG. 18 specifically, the minimum value Vmin of the detected voltage is derived from the photosensor outputs associated with reference patterns which are formed by laser power corresponding to tones 0–7. The minimum value Vmin tends to sequentially increase from the initial state indicated by a solid line to the states indicated by dash-and-dots lines due to the scratches and surface roughness of the drum. The illustrative embodiment determines whether or not the minimum voltage Vmin has changed due to aging. If it has changed, especially if it has risen, the embodiment determines that the surface conditions of the drum are not adequate for the control over the image density. Specifically, when the difference between the latest detected value and the preceding value is +0.3 volt with the minimum voltage detection error of ±0.1 volt taken into account, preferably when the voltage has risen by +0.5 volt with the linearity of the photosensor taken into account, the embodiment determines that the drum has to be replaced. Specifically, the minimum value of the detected voltages is determined on the basis of the equations (15)–(24). Then, as shown in FIG. 19, the surface potential or background potential Vsg of the drum is detected while the drum is rotated and the developing sleeve is held in a halt. Subsequently, an output voltage of the photosensor representative of a pattern density is inputted, and the minimum value Vmin is calculated by use of the equations (15)–(24). The resulted first pair is stored as an initial value. As soon as the minimum value Vmin of the detected values is calculated for the toner density control by the equations (15)–(24), it is compared with the initial value. If the minimum value Vmin is higher than the initial value by the above-mentioned value, it is determined that the drum has to be replaced, and a message for urging the user to replace it is displayed.

By the above procedure, it is possible to automatically determine the time for replacing the drum and, therefore, to inform the user of the deterioration of the drum. This further promotes the improvement in image quality.

In summary, the illustrative embodiment detects a signal representative of at reflection appearing when the photosensor output is minimum in response to a change in the amount of toner deposition on a photoconductive element. The embodiment, therefore, maintains a predetermined reference pattern to be formed for the detection of an image density in an adequate density despite the change in, for example, the reflection characteristic of the photoconductive drum, thereby enhancing high image quality. Even when the output of the photosensor is sharply changed due to aging, the embodiment insures the optimal image density. When the density of the reference pattern is brought out of an adequate range, the embodiment detects it automatically and sequentially selects different developing conditions to set up adequate conditions. Further, the embodiment reports the time for replacement of the photoconductive element automatically by checking the life of the element which effects the density control associated with the reference pattern.

Various modifications will become possible for those skilled in the art after receiving the teachings of the present disclosure without departing from the scope thereof.

What is claimed is:

1. An image forming apparatus comprising:

a photoconductive element;

charging means for charging a surface of said photoconductive element to a predetermined charge potential;

exposing means for exposing said charged surface of said photoconductive element by a predetermined quantity of light to electrostatically form a latent image thereon;

developing means applied with a predetermined bias for development of the latent image with a developer containing at least a toner;

sensor means for sensing a density of a predetermined visible reference pattern formed on said photoconductive element; and control means for changing at least one of a variable correction bias, the charge potential and the quantity of light in response to an output of said sensor means;

said control means changes the bias for development from a reference value by a predetermined potential difference in a direction for causing the toner to deposit on the photoconductive element, compares each of densities of reference patterns formed by the respective changed biases for development with a target density, determines a particular one of the biases for development based on a result of a comparison which shows that a toner has been deposited, and a mean value and a gradient of the densities of reflections from the reference patterns developed by predetermined ones of the bias for development preceding and succeeding said particular bias, calculates a shift of the bias for development based on said mean value and said gradient, and variably controls the bias for development on the basis of the calculated shift.

2. An apparatus as claimed in claim 1, wherein the reference value is a bias shifted from the background potential of said photoconductive element by a predetermined potential in a direction for causing the toner to deposit on the background.

3. An image forming apparatus comprising:

a photoconductive element;

charging means for charging a surface of said photoconductive element to a predetermined charge potential;

exposing means for exposing said charged surface of said photoconductive element by a predetermined quantity of light to electrostatically form a latent image thereon;

developing means applied with a predetermined bias for developing the latent image with a developer containing at least a toner;

optical sensor means for sensing a density of a predetermined visible reference pattern formed on said photoconductive element in terms of a reflection from said pattern;

control means for changing at least one of the bias, the charge potential and the quantity of light in response to an output of said optical sensor means representative of a reflection; and minimum signal detecting means for detecting a signal value appearing when the output of said optical sensor means is at or below a preselected minimum in response to a change in the amount of the developer deposited on said photoconductive element, wherein said minimum signal detecting means forms a plurality of visible reference patterns and said minimum signal detecting means forms at least three visible reference patterns and produces a signal indicating that the output of said optical sensor means is at or below said preselected minimum from secondary regression information based on outputs of said optical sensor means representative of reflections from said reference patterns.

4. An apparatus as claimed in claim 3, further comprising:

detecting means for detecting a characteristic value representative of a developing ability;

correction amount determining means for determining a correction amount on the basis of the characteristic value detected by said detecting means; and target density determining means for determining a target density of the density of the predetermined visible reference pattern by adding the minimum signal detected by said minimum signal detecting means and the correction amount determined by said correction amount determining means.

5. An apparatus as claimed in claim 4, wherein the correction amount to be determined by said correction amount determining means comprises a first correction amount to be determined on the basis of the characteristic value detected by said detecting means, and a second correction amount to be determined on the basis of said first correction amount.

6. An image forming apparatus comprising:

a photoconductive element;

charging means for charging a surface of said photoconductive element to a predetermined charge potential;

exposing means for exposing said charged surface of said photoconductive element by a predetermined quantity of light to electrostatically form a latent image thereon;

developing means applied with a predetermined bias for developing the latent image with a developer containing at least a toner;

optical sensor means for sensing a density of a predetermined visible reference pattern formed on said photoconductive element in terms of a reflection from said pattern;

control means for changing at least one of a variable correction bias, the charge potential and the quantity of light in response to an output of said optical sensor means representative of a reflection;

said control means determining whether or not a current dynamic range for image formation is adequate in response to outputs of said optical sensor means representative of reflections from at least two kinds of visible reference patterns, wherein said control means executes toner density control by determining whether or not a gradient of outputs of said photosensor, associated with tones which set up, among densities of the reference patterns, a highlight density, a single amount of correction in the dynamic range, and a gradient of a minimum value of said outputs, each lies in a predetermined range with respect to a gradient of an output representative of a target density of the reference patterns, determines that an image can be formed by said minimum value and said dynamic range if a result of said decision is positive, and determines that said target value based on said minimum value cannot be obtained if the result of said decision is negative.

7. An image forming apparatus having a photoconductive element, charging means, exposing means, developing means, optical sensor means, and control means, said apparatus comprising:

detecting means for detecting a characteristic value (TGRD) representative of a developing ability;

comparing means for comparing the characteristic value detected by said detecting means (detected TGRD) and a target characteristic value (target TGRD);

first correction amount determining means for determining a first correction amount on the basis of a result of comparison by said comparing means;

second correction amount determining means for determining a second correction amount on the basis of the first correction amount determined by said first correction amount determining means; and target density determining means for determining a target density (VTC) of the density of the predetermined visible reference pattern on the basis of the correction amounts determined by said first and second correction amount determining means.

8. An image forming apparatus comprising:

a photoconductive element;

charging means for charging a surface of said photoconductive element to a predetermined charge potential;

exposing means for exposing said charged surface of said photoconductive element by a predetermined quantity of light to electrostatically form a latent image thereon;

developing means applied with a predetermined bias for developing the latent image with a developer containing at least a toner;

optical sensor means for sensing a density of a predetermined visible reference pattern formed on said photoconductive element in terms of reflection; and control means for changing at least one of a variable correction bias, the charge potential and the quantity of light in response to an output of said optical sensor means representative of a reflection;

said control means determining whether or not a current dynamic range for image formation is adequate in response to outputs of said optical sensor means representative of reflections from at least two kinds of visible reference patterns and, if a result of said decision is negative, adjusting an amount of toner supply, wherein said control means executes toner density control by determining whether or not a gradient of outputs of said optical sensor means, associated with tones which set up, among densities of the reference patterns, a highlight density, a single amount of correction in the dynamic range, and a gradient of a minimum value of said outputs, each lies in a predetermined range with respect to a gradient of an output representative of a target density of the reference patterns, determines that an image can be formed by said minimum value and said dynamic range if a result of said decision is positive, and determines that said target value based on said minimum value cannot be obtained and adjusts an amount of toner supply if the result of said decision is negative.

9. An image forming apparatus comprising:

a photoconductive element;

charging means for charging a surface of said photoconductive element to a predetermined charge potential;

exposing means for exposing said charged surface of said photoconductive element by a predetermined quantity of light to electrostatically form a latent image thereon;

developing means applied with a predetermined bias for developing the latent image with a developer containing at least a toner;

optical sensor means for sensing a density of a predetermined visible reference pattern formed on said photoconductive element; and control means for changing at least one of a variable correction bias, the charge potential and the quantity of light in response to an output of said optical sensor means representative of a reflection;

said control means executing toner density control by determining whether or not a gradient of outputs of said optical sensor means, associated with tones which set up, among the densities of the reference patterns, a highlight density, a single amount of correction in the dynamic range, and a gradient of a minimum value of said outputs, each lies in a predetermined range with respect to a gradient of an output representative of a target density of the reference patterns, determining that an image can be formed at said minimum value and said dynamic range if a result of said decision is positive, and determining that said target value based on said minimum value cannot be obtained and variably controlling said dynamic range for image formation if the result of said decision is negative.

10. An image forming apparatus comprising:

a photoconductive element;

charging means for charging a surface of said photoconductive element to a predetermined charge potential;

exposing means for exposing said charged surface of said photoconductive element by a predetermined quantity of light to electrostatically form a latent image thereon;

developing means applied with a predetermined bias for developing the latent image with a developer containing at least a toner;

optical sensor means for sensing a density of a predetermined visible reference pattern formed on said photoconductive element; and control means for changing at least one of a variable correction bias, the charge potential and the quantity of light in response to an output of said optical sensor means representative of a reflection;

said control means executing toner density control by comparing a minimum value of outputs of said optical sensor means representative of reflections from the reference pattern formed on said photoconductive element with a value of the output of the photosensor when the optical sensor is in an initial state such as an unused state and, if said minimum value has risen from said value of the initial state, determining that said photoconductive element should be replaced, wherein said minimum value is produced by a minimum signal detecting means which forms at least three visible reference patterns and produces said minimum value from secondary regression information based on output values of said optical sensor means representative of reflections from said visible reference patterns.

11. An image forming apparatus comprising:

a photoconductive element;

charging means for charging a surface of said photoconductive element to a predetermined charge potential;

exposing means for exposing said charged surface of said photoconductive element by a predetermined quantity of light to electrostatically form a latent image thereon;

developing means applied with a predetermined bias for developing the latent image with a developer containing at least a toner;

optical sensor means for sensing a density of a predetermined visible reference pattern formed on said photoconductive element in terms of a reflection from said pattern;

control means for changing at least one of the bias, the charge potential and the quantity of light in response to an output of said optical sensor means representative of a reflection;

minimum signal detecting means for detecting a signal value appearing when the output of said optical sensor means is at or below a preselected minimum in response to a change in the amount of the developer deposited on said photoconductive element, wherein said minimum signal detecting means forms a plurality of visible reference patterns and said minimum signal detecting means forms at least three visible reference patterns and produces a signal indicating that the output of said optical sensor means is at or below said preselected minimum from secondary regression information based on outputs of said optical sensor means representative of reflections from said reference patterns;

detecting means for detecting a characteristic value representative of a developing ability;

correction amount determining means for determining a correction amount on the basis of the characteristic value detected by said detecting means;

target density determining means for determining a target density of the density of the predetermined visible reference pattern by adding the minimum signal detected by said minimum signal detecting means and the correction amount determined by said correction amount determining means;

bias determining means for determining a set condition of the bias for development;

first gradient detecting means for detecting a gradient of outputs of said optical sensor means associated with, among the visible reference patterns, first visible reference patterns formed by said exposing means by a minimum quantity of light and a quantity of light shifted by a predetermined tone from said minimum quantity of light in an increasing direction;

second gradient detecting means for detecting a gradient of outputs of said optical sensor means associated with, among the visible reference patterns, second visible reference patterns formed in a plurality of tones by quantities of light further shifted by predetermined tones from the shifted quantity of light in the increasing direction;

second control means for controlling at least one of the bias, the charge potential, the quantity of light and the toner concentration on the basis of the set condition of the bias determined by said bias determining means, the gradient detected by said first gradient detecting means, and the gradient detected by said second gradient detecting means; and means for determining and detecting a set condition of the bias after the control of said second control means, a gradient of outputs of said optical sensor means associated with the first visible reference patterns, and a gradient of outputs of said optical sensor means associated with the second visible patterns, and determining a characteristic value on the basis of said set condition and said gradients.

* * * * *